US012187393B2

(12) United States Patent
Colborn

(10) Patent No.: US 12,187,393 B2
(45) **Date of Patent: *Jan. 7, 2025**

(54) LOW PRESSURE SURFACE SUPPLIED AIR SYSTEM AND METHOD

(71) Applicant: Setaysha Technical Solutions LLC, Magnolia, TX (US)

(72) Inventor: John Craig Colborn, Magnolia, TX (US)

(73) Assignee: Setaysha Technical Solutions LLC, Magnolia, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/498,394

(22) Filed: Oct. 31, 2023

(65) Prior Publication Data

US 2024/0059384 A1 Feb. 22, 2024

Related U.S. Application Data

(63) Continuation of application No. 17/566,982, filed on Dec. 31, 2021, now Pat. No. 11,814,146, which is a (Continued)

(51) Int. Cl.
*B63C 11/20* (2006.01)
*B63C 11/14* (2006.01)

(Continued)

(52) U.S. Cl.
CPC ..... *B63C 11/202* (2013.01); *B63C 11/14* (2013.01); *B63C 11/18* (2013.01); *B63C 11/20* (2013.01);

(Continued)

(58) Field of Classification Search
CPC ..... B63C 11/00; B63C 11/02; B63C 11/12; B63C 11/14; B63C 11/16; B63C 11/18;

(Continued)

(56) References Cited

U.S. PATENT DOCUMENTS 3,467,091 A 9/1969 Aragona
3,907,236 A 9/1975 Sims, Jr.

(Continued)

FOREIGN PATENT DOCUMENTS

AU 2017222445 B2 11/2021
CN 109069781 A 12/2018

(Continued)

OTHER PUBLICATIONS

Notice of Allowance dated Jul. 12, 2023, U.S. Appl. No. 17/566,982, filed Dec. 31, 2021.

(Continued)

*Primary Examiner* — Colin W Stuart
(74) *Attorney, Agent, or Firm* — Timothy L. Scott, Esq.

(57) ABSTRACT

Methods and systems to provide breathing air to underwater divers in response to the divers' respiration at pressures less than 25 psi above atmospheric pressure during inspiration while delivering no or minimal air during exhalation, by controlling the actions of a pump during the time course of breathing. Methods and systems that sense a diver's need for breathing air, determine inhalation demand or exhalation state, and control the operation of a pump which delivers breathing gas to the diver via a tube. An integrated system for the same which incorporates at least an energy source, pump, air tube, breathing aperture, sensor, and logic processor is disclosed.

20 Claims, 6 Drawing Sheets

Related U.S. Application Data continuation of application No. 16/100,058, filed on Aug. 9, 2018, now Pat. No. 11,225,309, which is a continuation of application No. PCT/US2017/018802, filed on Feb. 22, 2017.

(60) Provisional application No. 62/299,119, filed on Feb. 24, 2016.

(51) Int. Cl.
*B63C 11/18* (2006.01)
*B63C 11/22* (2006.01)

(52) U.S. Cl.
CPC ..... *B63C 11/2227* (2013.01); *B63C 11/207* (2013.01)

(58) Field of Classification Search
CPC ..... B63C 11/20; B63C 11/202; B63C 11/207; B63C 11/2227
See application file for complete search history.

(56) References Cited

U.S. PATENT DOCUMENTS

| | | | |
|---|---|---|---|
| 3,965,892 | A | 6/1976 | Colston et al. |
| 4,022,201 | A | 5/1977 | Diggs |
| 4,111,342 | A | 9/1978 | Kirby |
| 4,238,864 | A | 12/1980 | Kealoha |
| 4,245,632 | A | 1/1981 | Houston |
| 4,269,182 | A | 5/1981 | Le |
| 4,324,195 | A | 4/1982 | Cunningham et al. |
| 4,442,835 | A | 4/1984 | Carnegie |
| 4,472,082 | A | 9/1984 | Kroling |
| 4,674,493 | A | 6/1987 | Mitchell |
| 4,756,486 | A | 7/1988 | Campbell |
| 4,832,013 | A | 5/1989 | Hartdorn |
| 4,986,267 | A | 1/1991 | Doss |
| 5,067,920 | A | 11/1991 | Brisky |
| 5,173,067 | A | 12/1992 | Biba |
| 5,193,530 | A | 3/1993 | Gamow et al. |
| 5,297,545 | A | 3/1994 | Infante |
| 5,327,849 | A | 7/1994 | Miller |
| 5,351,681 | A | 10/1994 | Hudson |
| 5,373,925 | A | 12/1994 | Handford et al. |
| 5,392,808 | A | 2/1995 | Pierce |
| 5,471,976 | A | 2/1995 | Smith |
| 5,506,571 | A | 4/1996 | Dugan |
| 5,535,734 | A | 7/1996 | Lu et al. |
| 5,694,923 | A | 12/1997 | Hete et al. |
| 5,697,572 | A | 12/1997 | Salentine et al. |
| 5,924,416 | A | 7/1999 | Miller |
| 5,938,140 | A | 8/1999 | Fundak |
| 5,947,116 | A | 9/1999 | Gamow et al. |
| 5,996,578 | A | 12/1999 | MacGregor |
| 6,299,581 | B1 | 10/2001 | Rapoport et al. |
| 6,817,359 | B2 | 11/2004 | Deas et al. |
| 7,011,089 | B2 | 3/2006 | Tokatlian |
| 7,159,528 | B1 | 1/2007 | Hilliker |
| 11,225,309 | B2 | 1/2022 | Colborn |
| 11,541,974 | B2 | 1/2023 | Colborn |
| 2004/0163642 | A1 | 8/2004 | Tokatlian |
| 2004/0168689 | A1 | 9/2004 | Kuriyama |
| 2004/0255943 | A1 | 12/2004 | Morris et al. |
| 2005/0268913 | A1 | 12/2005 | Morris et al. |
| 2007/0039617 | A1 | 1/2007 | Buhlmann et al. |
| 2008/0242162 | A1 | 10/2008 | Smith |
| 2009/0056718 | A1 | 3/2009 | Lindgren |
| 2010/0065055 | A1 | 3/2010 | Morris et al. |
| 2011/0308523 | A1 | 12/2011 | Carmichael et al. |
| 2016/0347432 | A1 | 12/2016 | Smith |
| 2021/0171168 | A1 | 6/2021 | Colborn |

FOREIGN PATENT DOCUMENTS

| | | | |
|---|---|---|---|
| DE | 19741424 | A1 | 5/1999 |
| EP | 0341085 | A1 | 11/1989 |
| EP | 0437948 | A1 | 7/1991 |
| EP | 3419709 | A1 | 4/2021 |
| EP | 3419709 | B1 | 4/2021 |
| GB | 2110566 | A | 6/1983 |
| WO | 1991001251 | A1 | 2/1991 |
| WO | 1997010991 | A1 | 3/1997 |
| WO | 1997012175 | A1 | 4/1997 |
| WO | 2016094944 | A1 | 6/2016 |
| WO | 2017147109 | A1 | 8/2017 |
| WO | 2019109014 | A1 | 6/2019 |

OTHER PUBLICATIONS

Office Action dated Mar. 16, 2023, U.S. Appl. No. 17/566,982, filed Dec. 31, 2021.
European Extended Search Report dated Jan. 31, 2019, European Patent Application No. 17757094.2 filed Sep. 24, 2018.
International Search Report dated May 16, 2017, International Patent Application No. PCT/US2017/018802 filed Feb. 22, 2017.
International Written Opinion dated May 16, 2017, International Patent Application No. PCT/US2017/018802 filed Feb. 22, 2017.
International Preliminary Report on Patentability dated Aug. 28, 2018, International Patent Application No. PCT/US2017/018802 filed Feb. 22, 2017.
Air Buddy, "Dive With The Ease of Snorkeling Into the Fascinating World Underwater", found at: https://www.airbuddy.net/, Aug. 21, 2021.
Third Lung, "Brownie's Third Lung", found at: https://www.browniedive.com/store/p36/SEA_LION_-_3_HOUR_FLOATING_HOOKAH_DIVING_SYSTEM.html, Aug. 21, 2021.
DiveAndFish, "Powerdive Power Snorkel", found at: http://www.diveandfish.com.au/special/powerdive-power-snorkel.html, Aug. 21, 2021.
Keene Engineering, "Keene HydroAir Battery Powered Floating Compressor Diving System", found at: https://keeneeng.com/2016/09/27/keene-hydroair-12-volt-hookah-system/, Aug. 21, 2021.
Colborn, John, "Low Pressure Surface Supplied Air System and Method," U.S. Appl. No. 62/299,199, filed Feb. 24, 2016.
Communication Pursuant to Article 94(3) EPC dated Jul. 23, 2019, European Patent Application No. 17757094.2 filed Sep. 24, 2018.
International Search Report dated Mar. 5, 2019, International Patent Application No. PCT/US2018/0063440 filed Nov. 30, 2018.
Colborn, John, "Low Pressure Respiration Gas Delivery Method," U.S. Appl. No. 62/593,870, filed Dec. 1, 2017.
Communication under Rule 71(3) EPC dated Sep. 7, 2020, European Patent Application No. 17757094.2 filed Feb. 22, 2017.
Communication pursuant to Article 94(3) EPC dated Dec. 20, 2019, European Patent Application No. 17757094.2 filed Feb. 22, 2017.
Written Opinion dated Mar. 5, 2019, International Patent Application No. PCT/US2018/0063440 filed Nov. 30, 2018.
International Preliminary Report on Patentability dated Jun. 2, 2020, International Patent Application No. PCT/US2018/0063440 filed Nov. 30, 2018.
Office Action dated Feb. 22, 2021, Australian Patent Application No. 2017222445 filed Feb. 22, 2017.
Notice of Allowance dated Sep. 9, 2021, U.S. Appl. No. 16/100,058, filed Aug. 9, 2018.
Pre-interview First Office Action dated Jun. 28, 2021, U.S. Appl. No. 16/100,058, filed Aug. 9, 2018.

Fig. 6 SIDE
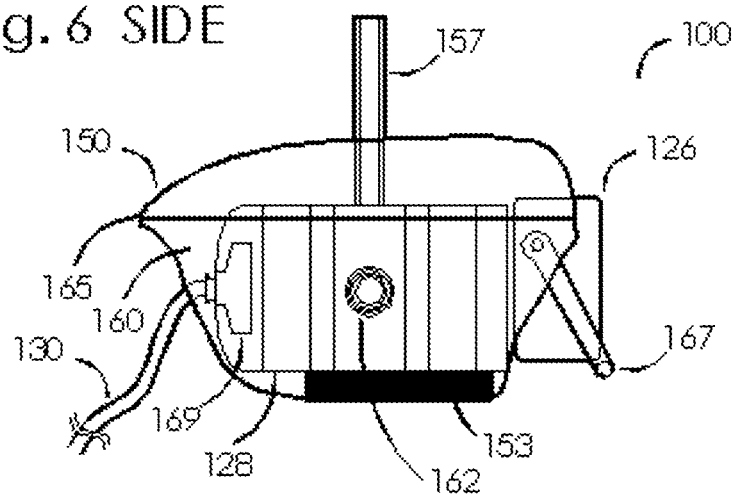
Fig. 7 TOP
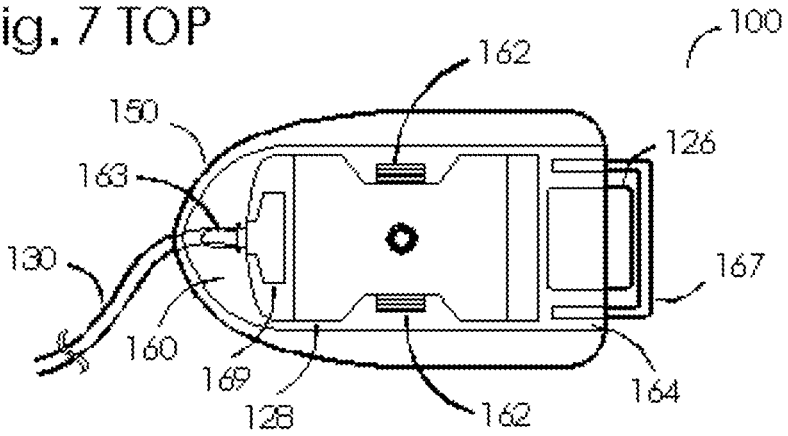
Fig. 8 FRONT
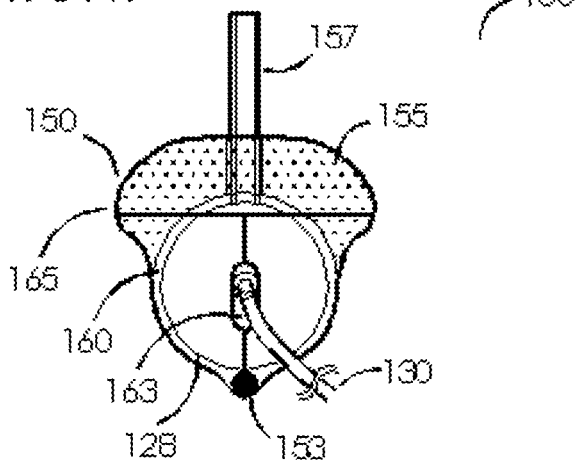

LOW PRESSURE SURFACE SUPPLIED AIR SYSTEM AND METHOD

CROSS-REFERENCE TO RELATED APPLICATIONS

This patent application is a continuation application of U.S. patent application Ser. No. 17/566,982, filed Dec. 31, 2021, entitled "Low Pressure Surface Supplied Air System and Method," which is a continuation application of U.S. patent application Ser. No. 16/100,058, filed Aug. 9, 2018, entitled "Low Pressure Surface Supplied Air System and Method," now U.S. Pat. No. 11,225,309, which is a continuation application of PCT Application No. PCT/US2017/18802, filed Feb. 22, 2017, entitled "Low Pressure Surface Supplied Air System and Method," which claims the benefit of priority to U.S. Provisional Patent Application Ser. No. 62/299,119, filed Feb. 24, 2016. Each of the foregoing patent applications and issued patents is hereby incorporated by reference herein in its entirety.

BACKGROUND OF THE INVENTION

The present disclosure relates to breathable gas delivery. More particularly, it involves systems and methods for delivering breathable gases to a submerged diver engaged in underwater activities.

Surface Supplied Air (SSA), or "Hookah" diving is a current means to provide breathable gas (e.g., air) to an underwater diver. SSA systems differ from SCUBA systems in that the diver is tethered to the surface via a flexible tube that delivers the breathable gases from a compressed gas container, pump or compressor. Current SSA pumping systems involve pressurizing the breathable gases at the surface using pumps or compressors to compress the breathable gas to a pressure in the range of 125 psi (861 kpa), then delivering the gas through a tube to a mouthpiece-mounted pressure regulator, which regulates the pressure drop at the time of delivery to the diver's mouth at the pressure determined by the diver's depth (e.g., 0-75 psi (0-517 kpa) above atmospheric pressure). As the diver descends below the water's surface, the pressure increases by approximately 0.43 psi (2.9 kpa) for each foot (0.3 m) of water depth for fresh water, and 0.44 psi (3.03 kpa) for each foot (0.3 m) of sea water. Stated differently, when a diver descends to about 33.9 feet (10.3 m) below the surface in fresh water, or to about 32.9 feet (10.0 m) in sea water, the absolute pressure will equal 2 atmospheres (atm) (203 kpa), with 1 atm (101.3 kpa) of the pressure due to the air pressure at the water's surface and 1 atm (101.3 kpa) due to the water pressure). Depending upon additional factors (e.g., variations in local salt or other mineral concentrations, the sea level elevation of the water surface, etc.), the increase in pressure may be slightly more or less than those provided above.

Based on the foregoing, for diving depths of less than about 100 feet (30.5 m), the pressure at the diver's depth will be less than about 4 atm (405.3 kpa) absolute pressure (about 1 atm (101.3 kpa) for the air pressure and 3 atm (304 kpa) for the water pressure) or 3 atm (304 kpa) gauge pressure (i.e., pressure above atmospheric pressure). Thus, for diving depths of less than 100 feet (30.5 m) from a sea level starting point, it is not necessary to compress the breathing gas more than about 45 psi (310 kpa). In fact, compression to pressures greater than what is necessary for the diver results in wasted energy, as the "overpressure" i.e., initial compression exceeding that needed by the diver, must be removed by a pressure drop valve to avoid damaging the diver's lungs and/or serious injury or death to the diver.

Relatively high pressures (i.e., over 50 psi (345 kpa) and typically over 100 psi (689 kpa)) are utilized in SSA equipment because the mouthpiece-mounted regulators used in Hookah diving are adapted from SCUBA designs which utilize even higher pressures, usually 500-3000 psi (3447-20684 kpa). The basic technology of SCUBA systems have not changed significantly in decades. Because of the elevated pressures involved, one or more pressure vessels capable of holding compressed breathable gases at the high pressures involved (up to 3000 psi (20684 kpa) in SCUBA systems and over 50 psi (345 kpa) in SSA systems) must be provided, along with a regulator system to de-pressure the gas down to the pressure needed by the diver. Consequently, SCUBA and SSA systems presently available are heavy, bulky, and require high energy inputs to develop the pressures involved, with much of the input energy being wasted as the excess pressure (or overpressure) which is then reduced to that actually required by the diver.

The weight, bulk, cost, and energy requirements of SCUBA and SSA systems significantly limit the availability of recreational diving to the general public. In the industrial boat and pool cleaning markets, the weight, bulk and cost of existing systems is added to that of the tools used by the diver to clean the boat or pool, which are themselves often bulky heavy and expensive, resulting in a significant fatigue burden to the diver as well as significant health and safety risks. There is a significant need in particular for lighter, less bulky equipment. Gas delivery systems disclosed herein deliver the same volume of breathing gas required by the diver, but with significantly less maximum system pressures than either SCUBA or SSA systems. By providing breathable gas without developing high overpressures, systems of the present disclosure offer lighter, less complex systems with significantly lower energy required compared to existing SSA systems. As a result, systems of the present disclosure can be lower in cost, less bulky, much more portable, and provide longer pump run-time for any given energy supply than conventional SSA systems.

Prior art systems that avoid high pressures also suffer from a number of drawbacks. U.S. Pat. No. 7,159,528 B1 discloses a diving system having a pump that operates at relatively low system pressures, but operates by means of free-flowing the pumped air past the diver's mouth. Such a system provides reduced energy efficiency and relatively poor performance as the diver's experience and vision are compromised by the continuous, free-flowing air bubbles flowing past the user which double during exhalation. SSA systems with continuous air delivery are used frequently in industrial applications such as cleaning ships, boats and pools. In these conditions, visibility may already be limited as the local area around the diver includes dirt and debris associated with the diver's cleaning efforts. The further limitation on visibility imposed by constant air bubbles makes a demanding job even harder. In addition, such systems are noisy, create pressure waves that cause alarm to fish and other aquatic life in recreational settings, provide a relatively artificial diving experience, and consume energy constantly during operation—even when the diver is not inhaling, with exhausted air that was not inhaled comprising wasted system resources. The magnitude of waste with the free-flowing air methodology is not immediately apparent but can be appreciated with the following situational example: The air consumption rate for a diver swimming at average speed is about 30 liters per minute total, which may infer a 0.5 Liter per second pumping rate, but the act of breathing involves inhaling part of the time, and exhaling part of the time, and so the pump of a free-flowing system would need to deliver at least 60 L/min rate during the inhaling cycle or a liter ever second to sustain metabolism for average swim speeds. Exhaling causes bubbles released from the lungs to be added to the free-flowing pumped air to be released, therefore, at a rate of 2 liters per second. Now then, a breathing air supply needs to be able to supply at a rate that also satisfies above average, or peak demands. The international standard EN250:2000 requires the ability to supply respiratory gas at a rate of 62.5 liters/minute. This equates to 2.08 Liters per second instantaneous flow rate, or nearly 125 Liters/minute for a continuously-running pump. Exhaling while using such a free-flowing system would cause bubble release at over four liters per second—a violent, noisy, visually disruptive air release.

Embodiments of the present invention provide a pump or compressor that operates on-demand to provide air to the diver. As used herein, "on demand" refers to a system in which the pump or compressor operates to pump air to the diver only in response to a determination that air is needed by the diver. Embodiments provided herein use a pumping system that senses the diver's respiration and operates the pump or compressor only in response to a determination of a need for air by the diver (e.g., by sensing one or both of inspiration and expiration by the diver). The pump is turned off when air is not needed or required by the diver. More specifically, in some embodiments, the pump is turned on when the diver is inhaling. In some embodiments, the pump is turned off when the diver is exhaling, or is neither inhaling nor exhaling.

Systems disclosed herein provide a fast pump response to a determination that the diver needs air, and operate to provide air in response to a signal that air is needed with a delay that is generally imperceptible to human divers. As such, the systems disclosed herein may provide at least double (and beyond 4×) run-time for any given energy supply compared to the free-flowing systems or more conventional SSA systems that pressurize the breathing gases to pressures of 50 psi (345 kpa) or higher. Put another way, on-demand systems disclosed herein may accomplish equivalent run-time using half or even one fourth of the energy (battery) capacity required of a free-flowing arrangement, usually less than 1/10 the energy of pressurizes SSA systems, and do not require an intermediate storage tank or specialized, high-pressure equipment associated with typical SSA systems. As used herein, "psi" refers to pressure developed in excess of atmospheric pressure, commonly referred to as "gauge pressure," or "psig" to designate that the units are pounds per square inch as measured by a pressure gauge for which 0 psi (0 kpa) is atmospheric pressure. Where absolute pressures are intended, the terms "absolute pressure" or "psia" are generally used.

SUMMARY OF THE INVENTION

In one embodiment, the present invention comprises a method of providing breathable air to a submerged diver in a system comprising a pump, a breathable air regulator having a pressure sensor coupled thereto, and a tube coupling the pump to the regulator, the method comprising: sensing pressure changes in the regulator associated with diver respiration using the pressure sensor; determining at least one of diver inhalation and diver exhalation based on said sensing; in response to said determining at least one of diver inhalation and diver exhalation, operating the pump during at least a portion of diver inhalation at a first pump speed to deliver breathable air to the submerged diver at a pressure of no more than 25 psi (172 kpa) above atmospheric pressure; and operating the pump during at least a portion of diver exhalation at a second speed that is no greater than half of the first speed.

In one embodiment, the present invention comprises a method of providing breathable air to a submerged diver in a system comprising a pump, a breathable air regulator having a pressure sensor coupled thereto, and a tube coupling the pump to the regulator, the method comprising: sensing pressure changes in the regulator associated with diver respiration using the pressure sensor; determining, based on said sensing, one of a need for air by the diver and the absence of a need for air by the diver; operating the pump, in response to determining a need for air by the diver, at a first speed to deliver breathable air to the submerged diver at a pressure of no more than 25 psi (172 kpa) above atmospheric pressure; and operating the pump, in response to determining the absence of a need for air by the diver, at a second speed that is no greater than half of the first speed.

In one embodiment, the present invention comprises a method of providing breathable air to a submerged diver in a system comprising a pump, a breathable air regulator having a pressure sensor therein, and a tube coupling the pump to the regulator, the method comprising: sensing pressure changes in the regulator associated with diver respiration in real time using the pressure sensor; performing a series of determinations, based on said sensing, at a frequency of at least 2 times per second, of one of a need for air by the diver and the absence of a need for air by the diver; operating the pump, within no more than 0.5 seconds after each determination of a need for air by the diver within said series of determinations, at a first speed to deliver breathable air to the submerged diver at a pressure of no more than 25 psi (172 kpa) above atmospheric pressure; and operating the pump, within no more than 0.5 seconds after each determination of the absence of a need for air by the diver within said series of determinations, at a second speed that is no greater than half of the first speed. In one embodiment, the present invention provides a system to provide breathable gases to a submerged diver, comprising a pump having a pump inlet fluidly coupled to a source of breathable gases at a first pressure and a pump outlet providing pressurized breathable gases to a submerged diver at a second pressure greater than the first pressure by no more than 50 psia (345 kpa); a breathable gas regulator assembly including a regulator chamber having a regulator inlet, a regulator outlet, a mouthpiece fluidly coupled to the regulator chamber and having a breathing aperture, and an articulating element or other pressure sensor to provide a signal indicative of whether breathable gases are needed by the diver based on movement of the articulating element or inhalation demand creating a pressure differential; tubing coupling the pump outlet to the regulator inlet; and a pump controller to control the operation of the pump based on the breathing gas signal.

In one embodiment, the present invention provides a system to provide breathable air to a submerged diver, including a floating pump assembly comprising a buoyant element, a pump coupled to the buoyant element and having a pump inlet fluidly coupled to the atmosphere and a pump outlet, said pump operating to provide pressurized breathable air at the pump outlet at a pressure greater than atmospheric pressure by no more than 25 psi (172 kpa); a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver inhalation and exhalation and to provide a signal indicative of the pressure changes; tubing coupling the pump outlet to the regulator inlet; a breathable air determination unit to determine when breathable air is needed by the diver based on the regulator pressure signal, and to provide a breathable air signal indicative of whether breathable air is needed by the diver; and a pump controller to control the operation of the pump in providing breathable air to the diver, based on the breathable air signal.

In one embodiment, the present invention provides a regulator assembly for a submerged diver, comprising: a regulator body comprising a breathing gas inlet for receiving breathing gas; a breathing gas outlet for elimination of exhalation gases; a mouthpiece having a breathing aperture through which the diver inhales and exhales; a regulator chamber in fluid communication with the breathing gas inlet, the breathing gas outlet, and the breathing aperture; a pressure sensor to sense pressure changes within the regulator associated with diver inhalation and exhalation and to provide a regulator pressure signal indicative of the pressure changes; and tubing having a first end coupled to the breathing gas inlet and a second end coupled to a breathing gas source at a pressure of 25 psi (172 kpa) or less; wherein said regulator assembly is not required to include a pressure drop valve to reduce the pressure of breathing gas received from the breathing gas source.

In one embodiment, the present invention provides a system to provide breathable air to a submerged diver, including a floating pump assembly comprising a buoyant element, a pump coupled to the buoyant element, the pump having a pump inlet fluidly coupled to the atmosphere and a pump outlet providing pressurized breathable air at the outlet at an outlet pressure greater than atmospheric pressure by no more than 25 psi (172 kpa); a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver inhalation and exhalation and to provide a regulator pressure signal indicative of said pressure changes; tubing coupling the pump outlet to the regulator inlet; a breathable air determination unit to determine inhalation by the diver based on said regulator pressure signal, and to provide an inhalation signal when the diver is inhaling; and a pump controller to cause the pump to operate when the processor provides the inhalation signal, and to not operate when the processor does not provide the inhalation signal.

In one embodiment, the present invention provides a system to provide breathable air to a submerged diver, comprising a pump having a pump inlet fluidly coupled to the atmosphere and a pump outlet, said pump operating to provide pressurized breathable air to a submerged diver at a second pressure greater than atmospheric pressure by no more than 25 psi (172 kpa); a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes; tubing coupling the pump outlet to the regulator inlet; a breathable air determination unit to determine, based on the regulator pressure signal, at least one breathing state of the diver selected from inhalation, exhalation, and non-breathing, and to provide a breathing state signal indicative of the at least one breathing state; and a pump controller to cause the pump to operate to pump breathable air to the diver during a breathing state signal indicative of either 1) inhalation or 2) neither exhalation nor non-breathing, and not operate during a breathing state signal indicative of either 1) non-inhalation or 2) either exhalation or non-breathing.

In one embodiment, the present invention provides a system to provide on demand breathable air to a submerged diver, comprising: a pump having a pump inlet fluidly coupled to the atmosphere and a pump outlet, the pump operating to provide pressurized breathable air to a submerged diver at a second pressure greater than atmospheric pressure by no more than 25 psi (172 kpa); a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes; tubing coupling the pump outlet to the regulator inlet; a breathable air determination unit to determine when breathable air is needed by the diver based on the regulator pressure signal, and to provide a breathable air signal indicating whether breathable air is needed by the diver; and a pump controller to cause the pump to operate to pump breathable air to the diver when the breathable air signal indicates that breathable air is needed by the diver, and to not provide breathable air to the diver when the breathable air signal does not indicate that breathable air is needed by the diver.

In one embodiment, the present invention provides a system to provide on demand breathable air to a submerged diver, comprising: a pump having a pump inlet fluidly coupled to the atmosphere and a pump outlet, the pump operating to provide pressurized breathable air to a submerged diver at a second pressure greater than atmospheric pressure; a breathable gas regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes; tubing coupling the pump outlet to the regulator inlet; a breathing air determination unit to determine when the diver is exhaling based on the regulator pressure signal, and to provide a breathable air signal indicating whether or not the diver is exhaling; and a pump controller to cause the pump to operate to pump breathable air to the diver when the breathable air signal indicates that the diver is not exhaling, and to not provide breathable air to the diver when the breathable air signal indicates that the diver is exhaling.

BRIEF DESCRIPTION OF THE DRAWINGS

Illustrative embodiments of the invention are described herein. In the interest of clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

Certain terms are used throughout the following description and refer to particular system components. As one skilled in the art will appreciate, components may be referred to by different names. This document does not intend to distinguish between components that differ in name but not function.

FIG. 6 is a side view of an embodiment of the pumping assembly.

FIG. 7. is a top-view of an embodiment of the pumping assembly.

FIG. 8. is a front-view of an embodiment of the pumping assembly.

DETAILED DESCRIPTION OF THE INVENTION

Figure 1:
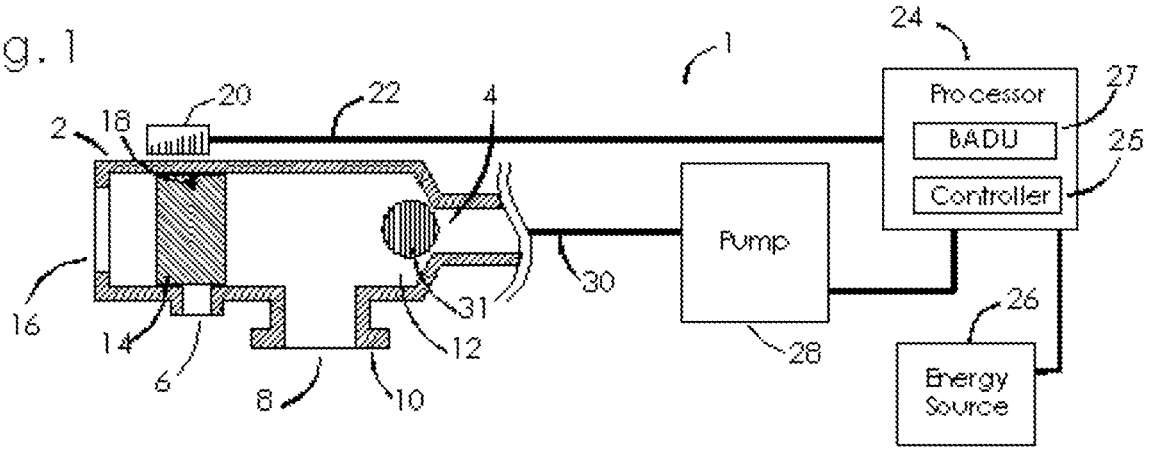
FIG. 1 is a functional system diagram illustrating system elements according to one embodiment when the user is in a state of breathing cessation.

In one aspect, the present disclosure provides systems for providing breathable gases to a submerged diver that minimize the pumping energy that must be supplied to the system Systems disclosed herein allow for delivery of breathing gases (e.g., air) that are compressed only to pressures suitable to supply the needed gas volume at a pressure matched to the diver's water depth. The relatively low maximum pressures developed by the pump in embodiments of the present disclosure also facilitates systems having an improved, simplified structure. In particular, systems of the present disclosure do not require high-pressure storage (e.g., a pressure tank or high-pressure tubing) or a pressure letdown valve to drop pressures from the relatively high pressures associated with SSA or SCUBA systems to the pressure needed by the diver. In some embodiments, systems disclosed herein also minimize the energy required for pumping breathable gases to a submerged diver by only operating the pump when air is needed by the diver. In some embodiments, the diver's need for air is determined by sensing one or more of inhalation, exhalation or non-breathing. In some embodiments, the pump is turned off when air is not needed by the diver, while in alternative embodiments, the pump may be operated at a substantially reduced capacity.

In SCUBA systems, for example, a first stage regulator (usually located on the diver-worn tank) drops the pressure from the tank pressure (e.g., 500-3000 psia; 3447-20684 kpa), to an intermediate pressure of around 120-160 psi (827-1103 kpa) above atmospheric pressure in the tubing connecting the tank to the second stage regulator, which is usually located immediately before the diver's mouthpiece. A pressure letdown valve is provided at the second stage regulator to reduce the pressure from the 120-160 psi (827-1103 kpa) level after the first stage to the pressure required by the diver (typically 1-5 atm absolute pressure (101-507 kpa) for sport diving up to approximately 130 feet (39.6 m)).

SSA systems typically involve lower air pressures than those associated with the first stage or tank of SCUBA systems, although pressures of 50-100 psi (345-689 kpa) are typical. Because of these relatively high pump (or compressor) outlet pressures, SSA systems require not only high energy input to the pump, but also intermediate storage of the pressurized gas (e.g., in a storage tank or using a suitably long length of high-pressure tubing), as well as a pressure letdown valve to reduce the pressure to that required by the diver (i.e., similar to the 2nd stage of a SCUBA system).

In contrast to the foregoing systems, embodiments of the present disclosure involve relatively low maximum pump output pressures (e.g., less than 50 psi (345 kpa), typically less than 25 psi (172 kpa), and more typically 15 psi (103 kpa) or less) above the pump suction pressure, which in many cases is atmospheric pressure. In some embodiments, the pump develops pressure only as necessary to enable delivery of the required amount of air to the diver, which varies according to the depth of the diver. Because the pump does not develop a significant "overpressure" above that needed by the diver, embodiments of the present invention do not require intermediate pressurized gas storage or a pressure reduction valve to reduce the maximum outlet pressure developed by the pump.

Accordingly, in some embodiments of the present disclosure, there is no intermediate storage of pressurized breathing gas, either in a storage tank or by maintaining an elevated pressure in the tubing/hose coupled to the diver regulator or mouthpiece. In some embodiments, there is no pressure reduction valve between the pump outlet and the regulator. In some embodiments a one-way check valve may be provided at the regulator/tube coupling (or other suitable location, e.g., within the regulator or in the tubing near the regulator) to prevent the diver's exhalation gases (which have a relatively high level of CO2) from flowing into the tubing line and back toward the pump. In other embodiments, a one-way check valve is not utilized near the mouthpiece because the pump's exhaust valve incorporates an equivalent one-way behavior.

It will be appreciated that pressures slightly higher than the pressure needed by the diver (e.g., less than 2 psi (13.7 kpa) greater than necessary) may be developed by the pump to enable the gas to overcome frictional losses in the connecting tubing, which may be as long as 50-100 feet (15-30 meters), and in the regulator assembly, to ensure that the pump can supply the required volume of breathable gas to the diver. In general, the pump only develops output pressures as needed to supply the diver with breathing gas at a given water depth and to overcome the above-noted frictional losses between the pump outlet and the regulator mouthpiece. Accordingly, intermediate gas storage and/or pressure reduction valves can be avoided in some embodiments.

In one embodiment, the system does not include a pressure reduction valve to reduce the second pressure at the pump outlet (i.e., the pressure developed by the pump above the first pressure, which may be atmospheric pressure, at the pump inlet). In one embodiment, the system does not include such a pressure reduction valve between the pump outlet and the regulator mouthpiece. In one embodiment, the pump provides a maximum outlet pressure of less than 50 psi (345 kpa). In one embodiment, the pump provides a maximum outlet pressure of 35 psi (241 kpa) or less. In one embodiment, the pump provides a maximum outlet pressure of 25 psi (172 kpa) or less. In one embodiment, the pump provides a maximum outlet pressure of 15 psi (103 kpa) or less.

In one aspect, the present disclosure provides systems for providing breathable gases on demand to a submerged diver by operating the pump to provide breathable gas to the diver in response to a determination that breathable gas is needed by the diver, and not operating the pump when there is no determination that breathable gas is needed by the diver. In some embodiments, the on demand system causes the pump to operate in response to a determination that breathable gas is needed by the diver, and stops the pump from operating when there is no determination that breathable gas is needed by the diver (or, alternatively, when there is a determination that breathable gas is not needed by the diver).

Embodiments of the present disclosure comprise a breathable gas regulator assembly to deliver breathable gases to the diver on demand. In one embodiment, the breathable gas regulator includes a pressure sensor to sense pressure changes within the regulator associated with diver inhalation and exhalation. The pressure sensor may comprise a completely passive element in one embodiment. In another embodiment, one or more articulating elements may be provided that respond to pressure changes by movement. The one or more articulating elements in the regulator are acted upon both by the pressure of the diving environment and the pressure of the diver's breath. The articulating element(s) move in response to the positive or negative pressure (relative to the pressure of the diving environment external to the regulator) of the diver's breathing in pushing or pulling gases into/out of the regulator during inhalation and exhalation. The position of the articulating element is thus a dynamic indicator of the diver's actions of exhaling, breathing cessation, or inhaling. In alternative embodiments, other movement-based sensing elements may be used to sense breathing-related pressure changes in the regulator instead of an articulating element, e.g., a valve that opens and closes at a threshold pressure differential, a piezoelectric element that vibrates differentially in response to varying pressure. In still other embodiments, sensing elements other than movement-based sensing elements may be used to sense pressure changes associated with the diver's breathing, e.g., a photonic (light-based) element, an auditory (sound-based) element, a temperature sensor sensing the increased temperature associated with the diver's exhalation. In further alternative embodiments, a chemical sensor may be used instead of (or in addition to) a pressure sensor to sense compositional changes in the gas within the regulator (e.g., rising or falling levels of carbon dioxide) as the diver exhales and inhales, respectively. In some embodiments, changes in volume or displacement are utilized to ascertain the diver's breathing actions as persons of ordinary skill in the art will appreciate the inextricable mathematical relationship between pressure and volume.

In some embodiments, the pressure sensor is an electronic sensor that detects pressure changes indirectly by detecting movement of an articulating element. The electronic pressure sensor sends a regulator pressure signal indicative of the magnitude of the movement of the articulating part to a processor or pump controller. In some embodiments, a processor receives the regulator pressure signal from the electronic pressure sensor and processes the signal to determine a breathing state indicative of a need for breathing gas by the diver. The breathing state may be one of an inhalation or inhaling state, an exhalation or exhaling state, and a non-breathing state. The processor may also provide a breathing gas signal indicative of the breathing state, or indicative of the diver's need (or lack of need) for breathable air. In some embodiments, the breathing gas signal generated by the processor is provided to a pump controller, which controls the operation of the pump to provide on demand breathing gas to the diver based on the breathing gas signal received from the processor. In alternative embodiments, the pressure sensor directly senses pressure within the regulator and sends a pressure signal indicative of the pressure to the processor and/or pump controller.

In some embodiments, the pump controller controls the action of the pump based on the regulator pressure signal, e.g., based on the magnitude of movement of the articulating element or on the signal directly indicative of regulator pressure, without determining a breathing state of the diver (e.g., without a processor). The pump controller may comprise one or more of circuitry, software, firmware, and logic elements to control the pumping action of the pump.

In one embodiment, the processor processes the pressure signal to determine when the diver is inhaling (e.g., an inhalation state), in which case the pump should be turned on, and either exhaling or not breathing (e.g., an exhalation state or a non-breathing state), which indicates diminished or no need for the pump to run. In some embodiments, the processor determines only when the diver is inhaling, and does not make a determination of either exhaling or non-breathing. In other embodiments, the processor determines only when the diver is exhaling, and does not determine if the diver is inhaling. In such "single state" processor systems, the pump may be turned on only when the diver is inhaling (or not exhaling), and/or turned off only when the diver is not inhaling (or is exhaling).

In one embodiment, the pump controller turns the pump on in response to an inhalation detection by the processor (e.g., determination of an inhalation state), and turns the pump off when there is no inhalation detection. In one embodiment, the pump logic controller may determine a breathing rate based on first sensor signal, and may control the pumping rate (i.e., the volume of breathing gas provided to the diver) in response to faster or slower inhalation rates. In one embodiment, the pump logic controller may provide additional pump control signals (in addition to "on" and "off") based on the pressure signal, such as pump soft-start or soft-stop to preserve pump and battery longevity.

In one embodiment, the pump controller determines one or more breathing states of the diver based on the pressure signal generated by the processor, and operates the pump based on the diver's breathing state. The pump controller may determine one or more breathing states including inhalation, exhalation, and non-breathing or breathing cessation. In one embodiment, the controller may then cause the pump to operate to pump breathable air to the diver during either inhalation, or alternatively in the absence of an exhalation or non-breathing state. In one embodiment, the controller may cause the pump to shut off (i.e., not operate or cease operating) during either exhalation or non-breathing states, or alternatively in the absence of an inhalation state. In some embodiments, the controller may cause the pump to operate to pump breathable air only when the diver is inhaling, and may cause the pump to shut off at all other times. In some embodiments, the controller may cause the pump to operate at all times except when the diver is exhaling. Embodiments of the present disclosure also train the diver to breathe continuously (and avoid breath-holding) while diving, since only by exhaling will the pump turn off, and only by inhaling with the pump turn on. Additional safety features may be provided to discourage breath-holding (a potentially harmful behavior for divers) if breathing is not detected within a certain time period (i.e., if one or more of inhalation or exhalation is not detected, or if non-breathing occurs for the time period), the pump may automatically be turned on.

In some embodiments, the pump may not stop entirely in response to a breathing gas signal indicative of exhalation, non-breathing, or non-inhalation, but may significantly reduce the pump speed to provide only a very small volume of air to the regulator assembly during exhalation or non-breathing. Such a system may have reduced efficiency compared to systems in which the pump is stopped completely when air is not needed, but may provide positive pressure to help preventing backflow of exhalation gases, prevent water entering into the tubing, or reduce motor starting load.

In one embodiment, the processor may determine the diver's depth based on the pressure signal received from the pressure sensor, and send a depth signal to the pump controller. The pump controller may use the depth signal to switch from a first operating mode to a second operating mode depending upon the depth of the diver. For example, when the depth signal indicates that the diver is at a depth of less than 10 feet (3 m), the pump controller may operate in the first mode by simply turning the pump off when the diver is not inhaling (or is exhaling or non-breathing), and may operate the pump at a first speed when the diver is inhaling. In contrast, when the depth signal indicates that the diver is at a depth of e.g. 10 feet (3 m) or greater, the pump controller may operate in the second mode by not turning the pump completely off during non-inhalation, exhalation or non-breathing, and instead operating the pump at a significantly reduced second speed that is sufficient to provide positive pressure in the tubing to prevent backflow of gases and/or water into the tubing, and reduce motor starting load. In some embodiments, in the second operating mode, the pump may also operate the pump at a higher speed during inhalation by the diver compared to the pump speed during inspiration in the first mode. The higher operating speed at the greater depth (and higher pressure) associated with the second operating mode may ensure that the pump develops pressure sufficient to ensure that the diver receives adequate breathing gases at the greater depth.

In alternative embodiments, the pump speed during both inspiration and expiration may be determined based on the depth signal received from the processor, with both the pump speed during inspiration and the pump speed during expiration increasing as a function of increasing diver depth to ensure both adequate air volume during inspiration and to prevent backflow during expiration or non-breathing. Such an embodiment, it should be noted, may have reduced energy efficiency compared to simpler modes of operation because the pump may be operating during periods in which the diver is not inhaling, or operating at higher speeds than would otherwise be the case, leading to greater energy usage.

In some embodiments, systems of the present invention includes a single pump to provide breathable air to a single diver. Such systems minimize energy waste since the pump can be shut off for approximately half of the diving time. In some embodiments, systems of the present invention include a dedicated pump, tubing line and regulator for each of multiple divers (e.g., a second, third, and/or additional divers). This minimizes the risk to each diver as each pump operates independently and separate batteries may be provided for each diver. The additional pumps, tubing line and regulators may be coupled to a single buoyant element in some embodiments, or to separate buoyant elements in other embodiments, to permit divers to travel in different directions underwater independently.

In some embodiments, systems of the present invention include a single pump capable of supporting multiple divers. In such a system, separate tubes for each diver may be coupled to a divider manifold. Such a system may require the pump to operate more frequently, and a more powerful pump capable of a wider range of operating speeds, as well as a controller capable of receiving multiple pressure signals and/or determining breathing states for multiple divers. In such embodiments, the processor will need to process the information to determine, and rapidly adjust, an instantaneous operating speed of the pump in order to support the wider range of total pumping volumes required in a single pump, multi-diver embodiment.

In some embodiments, the pump controller may determine and log information relating to the operating status of the system, including pump and power source monitoring and fault detection. Based on this information, the pump logic controller may cause the system to perform additional functions such as: entering a fail-safe operating mode, taking emergency action including activating an alarm to a diving monitor, signaling for help, tracking diver breathing activity and diving depth for a particular dive, providing feedback to the diver, provide lighting control such as turning on an emergency beacon, assist a diver engaged in underwater photography, providing a signal to the diver that one or more depth limits have been reached or exceeded, or other functions achievable by a pump logic controller which will become evident to persons of skill in the art in light of the present disclosure. The pump and necessary interfacing subsystems may include additional features to achieve durability and usability.

Certain aspects of some embodiments of the present invention may be more readily understood with reference to diagrams illustrating the system in three breathing states: diver inhalation, diver exhalation, and neither inhalation nor exhalation (i.e., cessation of breathing or non-breathing.

Referring to FIG. 1, an embodiment of an on demand system 1 for providing breathable gases to a diver according to the present invention is shown in a state of non-breathing (e.g., the diver's breathing cessation). The system includes a regulator assembly 2 having a breathing gas inlet 4 and a breathing gas outlet 6. Regulator assembly 2 also includes a mouthpiece 10 having a breathing aperture 8 through which the diver inhales and exhales. Mouthpiece 10 may be similar to common mouthpieces used, e.g., for snorkeling or SCUBA systems, except that no pressure drop valve is present in either regulator 2 or tubing 30 connecting the regulator to the outlet of pump 28. In the embodiment of FIG. 1, a one-way check valve 31 is provided at breathing gas inlet 4 to allow air from the pump 28 to enter the regulator assembly 2, and to prevent exhalation gases from entering tubing 30 and traveling back toward the pump. Regulator assembly 2 includes a regulator chamber 12 to allow breathing gases to be separated from the environment/water. Chamber 12 is in fluid communication with breathing gas inlet 4, breathing gas outlet 6, mouthpiece 10, and breathing aperture 8.

An articulating element 14 is positioned within the regulator chamber 12 such that it may move freely in response to pressure and volume changes within the chamber, including pressure and volume changes associated with diver inhalation and exhalation. In one embodiment, the articulating element 14 is provided with relatively close tolerances within chamber 12 such that it may move freely, but with little or no leakage of water or breathing gases into or out of the chamber. A port 16 is open to the environment, exposing one side of the articulating element 14 to the pressure of the environment (e.g., water when the diver is submerged), and the other side of the articulating part 14 to the pressure within chamber 12. The articulating part 14 incorporates a detection element 18 which facilitates movement detection by a sensor 20, which may comprise an electronic sensor (shown in FIGS. 1-3) or another type of sensor, e.g., a mechanical sensor or a light sensor. In one embodiment, detection element 18 comprises a magnet whose magnetic field may be sensed by the sensor 20. In other embodiments, a light emitting element (which may be sensed by a light sensor) may be used. Additional detecting & complementary sensing modalities may also be used (e.g., vibration, motion, force, acceleration, RF or other electromagnetic wavelength emissions). As previously noted, in an alternative embodiment, respiration may be detected chemically by rising and falling levels of carbon dioxide in the regulator as the diver exhales and inhales, respectively.

Referring again to FIG. 1, the sensor 20 communicates a regulator pressure signal to a processor 24. In one embodiment, the signal is communicated via wire 22. In alternative embodiments, a wireless connection (e.g., via Bluetooth or other wireless communication protocol) may be used to communicate the regulator pressure signal to the processor 24. The processor 24 includes a breathable air gas determination unit 27 (which in some embodiments may be a breathing gas determination unit for gases other than air such as Nitrox) and a pump controller 25. Breathable air determination unit (BADU) 27 processes the regulator pressure signal and determines when breathing gas is required by the diver. In some embodiments, the BADU 27 determines one or more breathing states of the diver from the regulator pressure signal, which may include inhalation, exhalation, or non-breathing. In some embodiments, the BADU 27 determines when air is needed by the diver, e.g., by movement of the articulating element corresponding with inhalation or exhalation. The BADU 27 also provides a breathing gas signal to the pump controller 25 indicative of the breathing state or a need (or lack of need) by the diver for breathing gas/air. In some embodiments, both the regulator pressure signal provided by the pressure sensor 20 and the breathing gas signal provided by the BADU 27 are real-time signals, by which is meant a signal with a relatively small time delay (e.g., less than 1 second, preferably less than 0.5 seconds, and preferably less than 0.1 second) from the physical phenomena being measured and the assertion of the signal. In the embodiment of FIG. 1, both the BADU 27 and the pump controller 25 are part of a single processor 24, although in alternative embodiments separate components may be used. The processor 24 (and by extension breathing gas/air determination unit 27 and pump controller 25) is coupled to an energy source 26 and a pump 28.

The pump 28 includes a suction-side inlet (not shown) to receive breathing gases from a breathing gas source, which may be the atmosphere in one embodiment, or a breathing gas mixture such as Nitrox in another embodiment. For simplicity, reference will generally be made to breathable air, although it should be understood that other breathable gases such as Nitrox are understood to be within the scope of the invention. In one embodiment, the pump 28 is located remotely from the diver, and includes an outlet (not shown) fluidly coupled to the regulator assembly 2 via tubing 30. Tubing 30 may be a polymer tubing capable of withstanding pressures up to at least 2 atmospheres, although in some embodiments the tubing may be capable of withstanding significantly higher pressures (e.g., 25-100 psi (172-689 kpa) or more) for safety. In some embodiments, tubing 30 does not need with be capable of withstanding pressures associate with conventional SCUBA or SSA systems, and may be lighter in weight, lower in cost, or provided with other desirable features (e.g., anti-kinking, bacterial resistance, etc.). It is to be appreciated that the system elements such as BADU 27, Controller 25 may be located generally in any area of the system (e.g., co-located with the sensor 20, or co-located with the pump 28, or other locations) and may or may not share the same processor 24 within the scope of the invention.

Referring again to FIG. 1, in the state of non-breathing, the articulating element 14 is balanced by the pressure within chamber 12 and the pressure of the environment at port 16 (i.e., water in the case of underwater diving). The sensor 20 detects that the detection element 18 is un-biased by breathing inhalation or exhalation, and the BADU27 determines from the regulator pressure signal that the diver does not need air (or is in a non-breathing state) and that the pump 28 should be turned off. The pump controller 25 responds to the breathing gas signal from the processor by turning the pump off or maintaining the pump in an off state.

Figure 2:
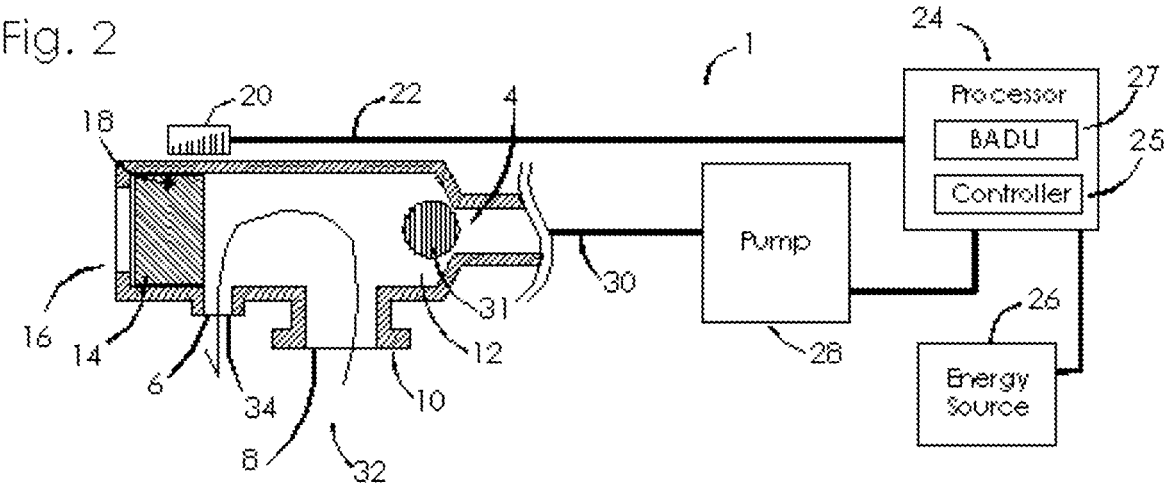
FIG. 2 is a functional system diagram illustrating system elements according to one embodiment when the user is in a state of breathing exhalation.

Referring now to FIG. 2, an embodiment of the system of FIG. 1 is shown in a state of exhalation. The diver exhales gas 32, typically a mixture of air and carbon dioxide, into the chamber 12 via breathing aperture 8, increasing the pressure in the chamber. To direct exhalation gases 32 solely through regulator outlet 6, a one-way-flow check valve 31 is provided at breathing gas inlet 4 to prevent exhalation gases from entering tubing 30 and traveling back toward the pump 28. The pressure of the diver's exhalation above the pressure in the chamber during inhalation closes check valve 31, which assures that the exhalation gases do not flow back toward the pump 28. The pressure of the diver's exhalation into chamber 12 also causes articulating element 14 to travel to the left (as pictured in FIG. 2) because the exhalation pressure within the chamber 12 exceeds the pressure of the environment at port 16, and breathing gas outlet 6 is opened. Exhaled gas from the diver's lungs continues to flow through breathing gas outlet 6 until exhalation ends and the diver again enters a temporary state of non-breathing (or proceeds directly to an inhalation state as shown in FIG. 3), when environmental pressure at port 16, either alone or with a biasing force (such as by a spring or flexible polymer, not shown) causes the articulating element 14 to close the breathing gas outlet 6.

Although the opening and closing of breathing gas outlet 6 is illustrated in FIG. 2 as occurring based on movement of the articulating element 14, other approaches may be used so long as a breathing gas outlet opens during exhalation. In one alternative embodiment, a non-moving pressure sensor (not shown) within chamber 12 can be used to directly measure pressure fluctuations within chamber 12 associated with the diver's inhalation and exhalation. The pressure sensor may send an electrical signal indicative of chamber pressure to the BADU27 which may process the signal to identify one or more of an inhalation state, an exhalation state, and a non-breathing state. The BADU 27 may send an electrical signal to close (for inhalation and non-breathing states) or open (for an exhalation state) a valve (not shown) regulating the flow of gas through breathing gas outlet 6. In another alternative embodiment, the diver's exhalation gases may cause a valve to open directly.

Referring again to FIG. 2, when the pressure sensor 20 detects, via the detecting element 18 in articulating element 14, that the diver is exhaling, the sensor 20 sends the regulator pressure signal to the breathable air determination unit 27, which determines that the diver is in an exhalation state and/or that the diver does not need air from the pump 28. The BADU 27 provides a breathing gas signal indicative of the exhalation state and/or that the diver does not need air to the pump controller 25, which asserts that the pump 28 need not be running, and turns the pump off or maintains the pump in an off state if it is already off. In the embodiments depicted in FIGS. 1-3, a single processor 24 integrates the functions of the BADU 27 and the pump controller 25 into a single unit. It will be appreciated, however, that two (or more) components may be used to provide the BADU 27 and the pump controller. The present description of the processor and controller as separate elements is provided for clarity and is not intended to be limiting.

Figure 3:
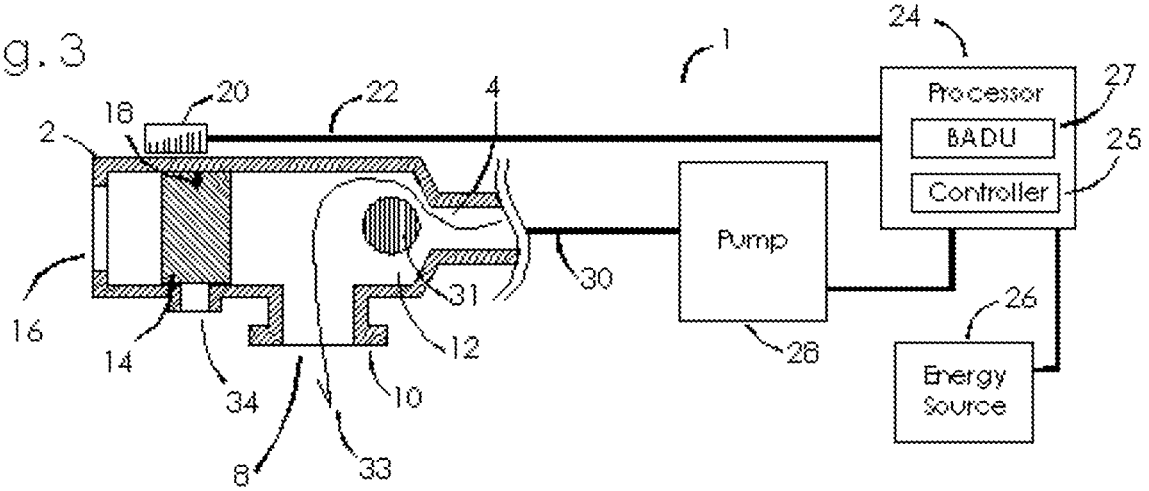
FIG. 3 is a functional system diagram illustrating system elements according to one embodiment when the user is in a state of breathing inhalation.

Referring now to FIG. 3, an embodiment of the system of FIGS. 1 and 2 is shown in a state of inhalation. As the user inhales breathable gas 33 (e.g., air or Nitrox) from the pump 28, the pressure inside the chamber 12 is reduced below that provided by the environment at port 16, causing the articulating element 14 to move to the right (as depicted in FIG. 3). The pressure sensor 20 detects that the detection element 18 has moved with the articulating element 14 into the position indicating an inhalation state, and sends the regulator pressure signal to the breathable air determination unit 27, which determines based on the regulator pressure signal that the diver is in an inhalation state and/or that the diver needs air from the pump 28. The BADU 27 provides a breathing gas signal indicative of the inhalation state and/or that the diver needs air to the pump controller 25, which determines that the pump 28 should be running, and turns the pump on or maintains the pump in an on state if it is already running. The pump 28 then pumps air to chamber 12 for inhalation by the diver through aperture 8.

When the pump 28 is running, its inlet receives breathing gas from a breathing gas source, which in one embodiment is air from the atmosphere. The breathing air is compressed by the pump, and delivered through the tube 30 to the chamber 12 of regulator assembly 2. The pressure developed by the pump 28 opens one-way check valve 31 at inlet 4 to regulator assembly 2, and the breathing gas passes into the chamber 12, where the diver may inhale it through breathing aperture 8. When the user ceases to inhale, the action of the pump causes the pressure in chamber 12 to increase until articulating element 14 again moves to the intermediate position shown in FIG. 1. Sensor 20 detects the movement of the detection element 18 in articulating element 14 back to the position shown in FIG. 1, and sends the regulator pressure signal to the breathing air determination unit 27, which again determines that the diver is in a state of non-breathing and in turn sends a breathing gas signal indicative of non-breathing to the pump logic controller 25. The pump controller 25 determines that the need for the pump to run is diminished or stopped, and sends a control signal to stop the pump.

It will be appreciated that in certain alternative embodiments the detection element 18 may be omitted, and movement of the articulating element 14 may be detected directly, e.g., by a laser light whose beam is interrupted or not interrupted as the articulating element moves within chamber 12, or by closing and opening an electrical circuit as the articulating element reaches certain positions (e.g., those shown in FIGS. 1-3).

In some embodiments, the processor 24, BADU 27, and/or pump controller 25 may include a self-calibrating function, wherein the neutral position (FIG. 1), and the exhalation (FIG. 2) and inhalation (FIG. 3) limit positions are learned during use to allow for proper function of the device despite part-to-part manufacturing differences or sensor drift over time. For example, the logic unit may measure and record the detection element 18 position immediately upon power-on. In this case the user is not using the system to breathe and so the recorded position may be taken as the neutral position e.g., FIG. 1. Before learning, an absolute threshold for sensory element travel may be applied to command the pump to run during inhalation; e.g., rightward-travel as depicted in FIG. 3, and to command the pump to not run during exhalation; e.g., leftward-travel as depicted in FIG. 2. These before-learning absolute thresholds allow for the system to function albeit in a coarse or non-optimal manner. During use, if the controller 25 is fashioned to measure and save maximum leftward and rightward positions, now the controller 25 may know the actual extents of travel and neutral position for this particular system despite all manufacturing, sensor drift, mechanical bias, user differences, and all other variables, and apply control logic such that the system behaviors are appropriately variable based on the user's inhalation or exhalation state and extents; e.g., pumping slowly if a slight inhalation demand is detected and pumping fast when an extreme detection element 18 position is detected. The saved positions may be transient; e.g., re-learned frequently such as upon each power cycle, saved e.g., learned infrequently such as once at the time of manufacture, or a mixture of these such as mathematically diminishing the extents over time until a renewed actual observation of a new sensor extent reading is encountered.

In some embodiments, unsafe condition(s) may be detected and the processor 24, BADU 27, and/or logic controller 25 may take one or more responsive actions. Unsafe conditions may include, without limitation, coughing, breathing cessation for more than a safe time period (e.g., 5, 10 or 15 seconds), rapid and/or shallow breathing, or deviations from established norms of breathing. Responsive actions that may be implemented include, without limitation, 1) logging and/or displaying (i.e., to the diver and/or a non-submerged diving monitor) the unsafe condition (e.g., the type of condition, time of occurrence, duration, etc.), 2) providing one or more alarms to the diver and/or monitor (auditory, visual, tactile, sensory, etc.), or 3) implement a corrective action (e.g., by altering the function of the pump, the regulator, or notifying the diver or non-submerged diving monitor). In some instances, safety features may be provided to cause the diver to surface involuntarily if diagnostic conditions indicate that the diver may be incapacitated or injured, as explained more fully below.

In some embodiments, processor 24 may include battery monitoring, logging and/or reporting features wherein the diver or non-submerged diving monitor) may be informed of one or more diagnostic conditions, such as the battery state (e.g., remaining capacity or pump operating time at current operating conditions).

As a non-limiting example, when the processor 24 detects a battery low condition, it may assert a delay period (e.g., from 0.1 to 1.0 seconds) between the determination of an inhalation state/need for air and turning on the pump. In another embodiment, the controller may provide for a deliberate slowing in the rate of delivery (e.g., by a continuous or shorter-term pulsed or other interrupted delivery of breathing gases). For example, the controller may cause the pump to provide a single interruption pulse of the pump's operation during the inhalation to indicate that half of the batter capacity remains, and more pulses (e.g., 2, 3 or more interruption pulses of the air supply during what would otherwise be a single continuous air supply during a breath by the diver) to indicate that the battery is nearly empty.

In another embodiment, the processor 24 and/or pump controller 25 may require a greater inhalation effort (e.g., by requiring a greater deflection of articulating element 14) from the diver before the pump is turned on when a battery low condition is detected. In still another embodiment, the processor 24 and/or pump controller 25 may cause the pump to cease delivering air on normal inhalation, and may only deliver air in response to the diver manually pressing a demand-flow button. Such a system behavior forces the diver to acknowledge the battery depletion or near-depletion. Alternatively, the processor may maintain a reserve capacity of a fixed time, number of breaths, or air volume delivery capacity after the diver is informed of a low battery condition. In one or more of the foregoing ways, the user may be alerted to a battery-low condition in a manner that does not require extra system components and that also informs the diver of the need to surface without undue inconvenience. In other embodiments, a warning element (e.g., a light, a speaker, or a vibrating element) may be provided in or on the regulator assembly 2, and may be activated when a low-battery or condition is detected or identified by logic controller 25. The warning element may be activated by wire or, in some embodiments, by wireless signal from the logic controller.

In some embodiments, the system may provide attachments to allow the diver to inflate an air reservoir, such as a buoyancy control device (BCD) commonly used in SCUBA diving, to control the diver's buoyancy while submerged. In one embodiment, a BCD (buoyancy control device) branch may be provided in the tubing 30 to allow the diver to use a manual demand-flow button to inflate the diver's BCD. In one embodiment, a low battery condition may automatically trigger partial or further inflation of the diver's BCD, making it more difficult for the diver to remain submerged or even forcing the diver to surface.

In one embodiment, one or more corrective actions may be implemented on detecting an undesirable state (e.g., low battery, excessive diver depth, failure to detect respiration or detecting slow respiration, etc.). In one embodiment, an emergency rescue (ER) reservoir may be provided on or near the regulator assembly 2, and may automatically inflate if the processor 24 or BADU 27 determines that the diver has ceased breathing for a predetermined time period, e.g., 15 seconds, 20 seconds, or other predetermined or programmed time interval. For example, the BADU 27 may send an emergency inflation signal to the pump 28 if one or more conditions indicative of breathing has not been detected for the predetermined time period, (e.g., the BADU 27 has not detected inhalation (or exhalation) in more than 15 seconds since the prior inhalation (or exhalation); or the BADU has not detected a change in the breathing state of the diver in more than 15 seconds; or the pressure with the regulator has not changed in more than 10 seconds).

In some embodiments, the ER reservoir may be attached to the regulator assembly 2 and may be automatically inflated upon detection of one or more of the emergency breathing states noted above that may indicate diver distress. In other embodiments, the ER reservoir may be coupled to a separate emergency rescue branch off the tubing 30. In this case, the BADU 27 or processor 24 may send a signal to the pump to inflate the ER reservoir, and another signal to an ER valve in the rescue branch, opening the rescue branch to allow the pump to inflate the ER reservoir. In some embodiments, the ER reservoir may be coupled to the diver, e.g., as a collar or vest that is automatically inflated upon detection of an emergency breathing state. While the ER reservoir may be of any desired size, in one embodiment the ER reservoir would be sized to provide buoyancy sufficient to cause any human diver to surface. In yet another embodiment, the ER reservoir may be coupled to the patient's body (e.g., the ER may be a standard SCUBA BCD) and may be oriented such that, when the user is brought to the surface, the ER automatically causes the user's airway (e.g., the user's mount and nose) to float stably above the water. Thus, if the diver becomes unconscious underwater and is brought to the surface by inflating the ER reservoir, the diver will avoid further inhaling water into the lungs.

In some embodiments, an emergency locator device may be deployed, which may consist of an ER reservoir being completely detected from the system and allowed to float to the surface. The locator device may include features (bright colors, flashing or colored lights, audio signals, etc.) to call attention to the locator device. Other corrective actions may also be implemented by the system in response to an emergency condition, including automatically causing ballast weights attached to the diver to be dropped, or causing a reel to automatically retract or "reel in" the tubing 30, thereby moving the diver to the surface. Many different system configurations are possible to deliver low-pressure breathing gases to a diver utilizing the principles described herein. FIGS. 1-3 illustrate an articulating part 14 that slides within the regulator assembly 2. However, as already noted, other configurations or types of articulating elements or other means to sense the user's inhalation or exhalation intentions may be used in different embodiments.

Figure 4:
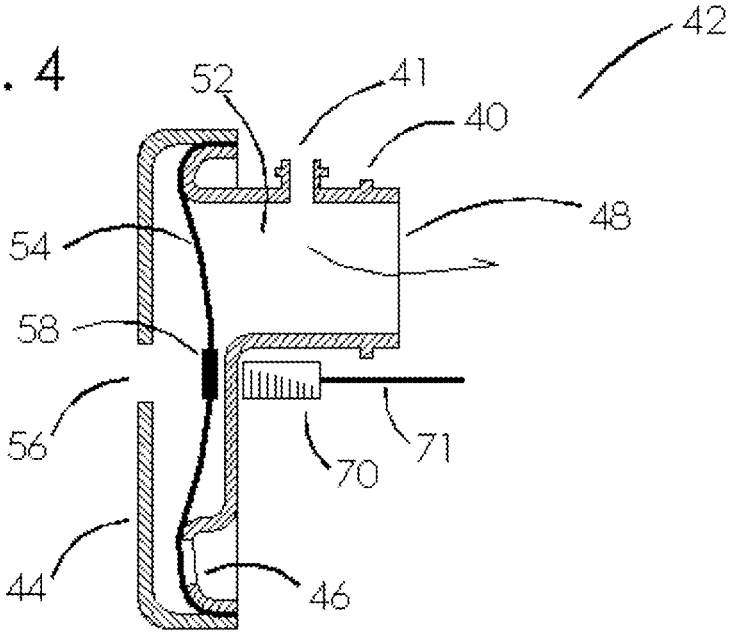
FIG. 4 is a cross-sectional view of an embodiment of a regulator assembly illustrating elements during inhalation.
Figure 5:
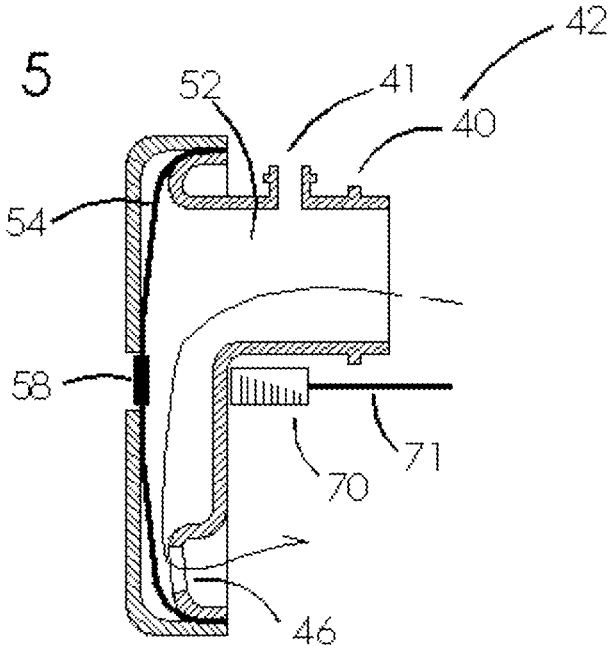
FIG. 5 is a cross-sectional view of an embodiment of a regulator assembly illustrating elements during exhalation.

FIGS. 4 and 5 present an alternative embodiment of an articulating element portion of a regulator assembly 42 which provides advantages for simplicity of manufacturing and reliability by using a deflecting articulating element 54. A portion of a regulator assembly 42 is depicted in section-view through the largest diameter of an otherwise generally cylindrical-shaped body. Regulator assembly 42 is similar to regulator assembly 2 of FIGS. 1-3 in some aspects, although certain other features that would be provided in a working system are omitted from FIGS. 4 and 5 for simplicity.

Referring again to FIGS. 4 and 5, connecting feature 40 may be incorporated in the regulator assembly 42 of FIGS. 4 and 5 to interface with standard, commercially-available snorkeling or diving mouthpieces with tubular interconnects, which may be obtained in a variety of sizes and properties to suit a wide range of user preferences. The tubular mating feature 40 allows the breathing aperture 48 of FIG. 4 to be connected to a mouthpiece similar to mouthpiece 10 shown schematically in FIGS. 1-3 but not illustrated in FIG. 4. An air inlet 41 may comprise a connecting feature such as the flange (not numbered) shown in FIGS. 4 and 5. The air inlet 41 connecting feature may be used to connect the regulator assembly 42 to an air supply tube, also not shown in FIGS. 4 and 5. Similarly, a one-way check valve may optionally be provided as part of inlet 41 or in the unshown air inlet tube, although the check valve may be omitted entirely in some embodiments. Other system features illustrated in FIGS. 1-3, e.g., a pump, a processor comprising a breathing air/gas determination unit and/or a pump logic controller, a power source, and so forth, would also be provided to form a complete system with the regulator assembly 42 of FIGS. 4 and 5.

FIG. 4 provides a first sensor 70 to sense movement of an articulating element 54. In FIG. 4, the articulating element 54 comprises a flexible diaphragm or membrane made of a flexible material such as plastic or rubber that is resilient as well as resistant to corrosion or damage from salt water. In some embodiments a metal diaphragm may be used.

In FIGS. 4 and 5, the area to the right of the articulating element 54 is fluidly coupled to the pump and tube delivery system, and to the diver's lungs through breathing aperture 48 of chamber 52. Conversely, the area to the left of the articulating element is fluidly coupled to and receives the pressure of the external environment (e.g., the local water pressure for a submerged diver) through opening 56 in regulator assembly 42. Referring to FIG. 4, when the diver inhales, the pressure in the chamber 52 decreases as the diver removes (i.e., breathes in) gas from the regulator chamber 52, causing the chamber pressure to fall below the external pressure acting on the left side of the articulating element 54, resulting in a pressure imbalance that causes the articulating element 54 to deflect to the right (as pictured). The deflection of articulating element 54 to the right also closes and seals the breathing gas outlet 46, preventing water from entering the chamber 52 during inhalation. The exhaust port 46 is fabricated to facilitate this sealing function. The angle through which the diaphragm deflects may be chosen to facilitate some amount of bias, such as 5-degrees, but not so much that the diver must develop an uncomfortable amount of force during exhalation to overcome the seal. In one embodiment, a 0.012-inch (0.3 mm) thick silicone articulating element 54, pre-stretched to 20% elongation, may be used with a 5-degree angle to the port opening 46, but many variations of material thickness, composition, stretch, diameters, and angle may be configured to regulate the ease of breaking the diaphragm/breathing gas outlet seal during exhalation without undue experimentation, given the benefit of this disclosure.

In one embodiment, movement of a detection element 58 coupled to articulating element 54 may be sensed by a sensor 70 and used to determine when to operate the pump (not shown) to provide air to the diver through inlet 41. Detection element 58 may be selected from a variety of elements, e.g., a magnet, an optical element, etc. In one embodiment, a pair of magnets aligned and positioned to engage one another across the wall of a diaphragm, are used as the detection element 58. The sensor 70 may use the strength of the magnetic field to determine when to operate or not operate the pump. However, regardless of the type of signal (e.g., magnetic, photic, acoustic, etc.) provided by the detection element 58, sensor 70 may use the strength of the detection element signal as a feedback control signal to a controller (e.g., controller 25 of FIGS. 1-3) to decide when to turn the pump on and off. In the embodiment of FIG. 4, the sensor 70 provides an articulating element position signal which may be used to control the pump. In one embodiment, the position signal may be an electrical signal along wire 71. In alternative embodiments, the sensor may generate a radiated electromagnetic signal, an optical signal, an acoustic signal, or other signal to indicate the position of the articulating element.

In one embodiment, a processor may use the articulating element position signal from sensor 70 to control the operation of the pump by directly or indirectly determining diver inhalation, exhalation and breathing cessation. In one embodiment, the processor may explicitly determine one or more of inhalation, exhalation and breathing cessation states based on the articulating element position signal. Alternatively, the articulating element position signal may be used indirectly to indicate the breathing state by providing an indication of distance between the detection element and the sensor. As used herein, the processor is capable of "determining a breathing state" so long as it is capable of processing the articulating element signal from sensor 70 to determine whether or not the diver needs air, and thus whether the pump should be turned on or off. This includes both an explicit determination of a breathing state of the diver (e.g., inhalation, exhalation, or breathing cessation), or an indirect indication of the breathing state (e.g., that inhalation by the diver has caused the articulating element 54 to move into close proximity to the sensor 70, as shown in FIG. 4). In another alternative, the processor may indirectly determine that inhalation is occurring by determining that the articulating element has begun to move toward the sensor, or that the change in the sensor signal indicates that the distance between the detecting element 58 and the sensor 70 is decreasing. Similarly, the processor may indirectly determine that exhalation is occurring by determining that the articulating element has begun to move away from the sensor, or that the change in the sensor signal indicates that the distance between the detecting element and the sensor 70 is increasing. The processor may process the articulating element position signal from sensor 70 (e.g., by a breathing air determination unit 27) to generate a pump control signal (e.g., by a pump controller 25) to cause the pump to operate or not operate. Thus, "determination of a breathing state" includes both an explicit determination by the controller 25 and/or breathing air determination unit 27 that the diver is one or more of inhaling, exhaling, or not breathing, as well as indirect indications (e.g., articulating element position) thereof.

Referring again to FIG. 4, when articulating element 54 and/or detection element 58 is moving toward (or is in) the position shown in FIG. 4, the articulating element position signal from sensor 70 will be used to indicate to the processor and/or BADU that the diver is inhaling, and the processor and/or controller will generate a control signal to turn the pump on and cause breathing air to be delivered to regulator inlet 41 (e.g., via a tube coupled to the flange connecting feature incorporated into the inlet shown in FIG. 4).

In one embodiment, sensor 70 comprises a Hall effect sensor, which can detect distance changes without contacting the moving part (e.g., the articulating element 54 or the detection element 58). Sensor 70 can therefore in some embodiments be completely encapsulated in a material that seals any electronic components from the surrounding water without compromising the sensor's distance sensing ability.

In the embodiments of FIGS. 4 and 5, an articulating element cover 44 provides protection from physical damage to sensitive internal parts such as the articulating element 54. The inside dimension of the cover 44 is sized to allow sufficient outward-travel (i.e., movement during exhalation, as shown in FIG. 5) of the articulating element 54 and/or detecting element 58 to facilitate opening breathing gas outlet 46, and to allow sensor 70 to determine an exhalation state, but at the same time is restricted enough to constrain the articulating element from damage or malfunction in an over-pressure event that could otherwise cause a membrane to exceed its maximum allowable elongation and leading to possible rupture. The dimensions of the cover 44 to the chamber-side portion of the regulator assembly 42 are also chosen to facilitate an air-tight seal between the chamber 52 and articulating element 54. Suitable structures to attach the cover 42 may include one or more mechanical features such as screws, clamps, pins, springs, etc., adhesives, or any means known to persons of skill in the art. Opening 56 in cover 44 of regulator assembly 42 allows water pressure from the surrounding environment at the diver's depth to exert the same pressure on articulating element 14 as it exerts on the diver's mouth and/or lungs. Opening 56 also allows the diver to override the pressures acting on the articulating element 54 and cause the pump to deliver air to the regulator assembly 42 by manually pressing and moving the detection element 58 and, by extension, articulating element 54. The ability to manually initiate air flow is similar to the ability of SCUBA divers to manually cause air to flow through the SCUBA mouthpiece using the SCUBA regulator end cap button, although through completely different physical mechanisms and without the high pressures and dual pressure-drop valves present in SCUBA systems.

Referring now to FIG. 5, when the diver exhales, the chamber 52 pressure increases as exhalation gases from the diver's lungs is expelled into the chamber. This causes the pressure in the chamber to exceed that of the external environment acting on the left side of the articulating element 54, resulting in a pressure imbalance that causes the articulating element 54 to deflect to the left (as pictured). The movement of the articulating element 54 to the left also opens the breathing gas outlet 46 and allows the exhaled gases to exit the chamber through the outlet until the end of exhalation. Although not shown in FIG. 5, it will be appreciated that a one-way valve similar to one-way valve 31 of FIG. 1 may optionally be employed in or proximate to breathing gas inlet 41 to prevent exhaled gases from entering the delivery tube coupling the pump to the regulator assembly 42, and traveling back toward the pump. As the detection element 58 travels away from the sensor 70, a signal indicative of the distance between the detection element 58 and sensor 70 is sent to the processor (similar to the processor 24 of FIG. 1) for determination of whether to run the pump. As the diver exhales and the detection element moves from a position similar to that of FIG. 4 to that of FIG. 5, the signal from sensor 70 may be processed by processor 24 (e.g., by a breathing air determination unit 27 within processor 24, as shown in FIGS. 1-3) to indicate that exhalation is occurring and/or that the distance between the sensor 70 and the detection element 58 is increasing. It will be appreciated that sensors and deflecting elements may be configured differently than as depicted here; e.g., such that distances described herein as increasing can be configured to be caused to be decreasing under equivalent circumstances, and that alternate configurations are considered within the scope of this invention. Once the processor and/or BADU determines that exhalation is occurring, the processor and/or pump controller may send a control signal to the pump to turn the pump off.

In an alternative embodiment to that shown in FIG. 5, upon cessation of exhalation, the stretch-bias of the membrane articulating element 54 closes the breathing gas outlet 46, preventing water intrusion when gases are not being exhaled through the breathing gas outlet. In this embodiment, the amount of force required by the user to cause exhaling is adjustable by design in the choice of the angle of the port 46 opening in relation to the angle and stretch bias of the articulating element (e.g., polymer membrane) 54. In other embodiments, exhaling is allowed by any manner of one-way valves fluidly coupled to the mouthpiece as is the present art in SCUBA mouthpieces (not pictured here). In one embodiment, the mating features 40 allow that the entire assembly pictured in FIGS. 4 and 5 to be rotated in relation to the mouthpiece (not shown). Rotating the assembly such that the breathing gas outlet 46 is gravitationally lower than the mouthpiece facilitates unintended fluid (e.g., water) in the chamber 52 to migrate away from the path of inhalation and toward the breathing gas outlet, such that at the next exhalation cycle, unwanted fluids are expelled through the breathing gas outlet along with exhaled gases.

In some embodiments, the detection and logic elements (e.g., the sensor element, sensor, processor, BADU and/or pump controller) are caused to trigger a decision to run the pump by means other than the user's inhalation or exhalation forces. As illustrated, the diver may use finger motion to push the sensory element 58 toward the sensor 70 to manually cause air delivery through the detection and logic elements. In other embodiments, manual pump operation may be triggered by way of biting action, tongue movement, hand motions, or other manner which will be apparent to a person of ordinary skill in the art in view of the present disclosure.

In some embodiments, systems of the present invention involve a floating pump assembly comprising a buoyant element coupled to the pump. The buoyant element enables the pump to remain at or near the surface of the body of water in which the diver is submerged, such that the pump suction is capable of in taking air and avoiding the intake of water. Buoyant elements of the present invention may maintain the pump at, above, or below the water line. The pump may be inside, outside, partially inside or partially outside of the buoyant element.

FIGS. 6-8 illustrate one embodiment of a floating pump assembly 100 comprising a pump 28 coupled to a buoyant element according to the present invention. Many configurations are possible for a floating pump assembly that includes a pump and necessary support systems such as a power source and a pump logic controller. Persons of skill in the art having the benefit of the present disclosure will appreciate that numerous alternative embodiments having fewer or additional features than those disclosed herein may be implemented without departing from the scope of the present invention as disclosed herein.

Referring to FIGS. 6-8, a floating pump assembly 100 includes a buoyant element comprising a pump assembly housing 150 for a pump 28. In some embodiments, the pump assembly housing 150 is constructed of, or incorporates, a buoyant material which is corrosion resistant to survive extended salt water exposure. Exemplary materials include, without limitation, polymers having a specific gravity of less than 1.0, including without limitation open or closed-cell polymeric foams, honeycombed composite materials capable of minimizing or eliminating water ingress, etc. The material may also be provided with coloration throughout the thickness rather than merely its surface, to maintain aesthetic coloration despite inevitable scratching and abrasion of the housing material.

In one embodiment, the buoyant pump assembly housing 150 is shaped so as to facilitate easily gliding through the water when pulled by tube 130 as a result of movement of the diver. Aerodynamic shapes akin to boat hulls may be used, for example. In one embodiment, the pump assembly housing 150 may be shaped to minimize points or sharp edges to reduce the risk of being snagged on items in the environment such as the diving regulator and tubing, coral, submerged structures, vegetation, nearby boating or other vessels, or debris. Smooth, round edges may be utilized to reduce "drag or snag" potential.

In one embodiment, the pump assembly housing 150 is shaped to minimize the risk of harm to a user's head, foot, or other body structure in the case of collision, which may occur when the diver is surfacing and the pump assembly housing is above the diver. In some embodiments, soft materials or coatings are utilized to reduce or eliminate the risk of harm should the diver (or others) bump into the pump assembly housing 150. In general, the pump assembly housing 150 utilizes fault-tolerant flotation elements such as incorporating closed-cell foam or sealed chambers 155 so as to prevent sinking of the floating pump assembly 100 in the event of a leaking seal or mechanical damage.

In some embodiments, the pump assembly housing 150 is shaped so as to provide a controlled buoyancy that is self-righting and capsize-resistant or capsize-proof. Reduced risk of capsizing is important to avoid submerging the pump inlet and causing water rather than breathing gases to be pumped to the submerged diver. By proper selection of materials and geometry, the floating pump assembly 100 may provide a self-righting structure with a low center of gravity. In one embodiment, heavier components within the pump assembly housing 150, such as the motor's coil windings and magnetic core, may be located relatively low in the assembly to lower the center of gravity and promote a self-righting floating assembly.

In one embodiment, the pump assembly housing 150 is structured so as to provide buoyancy sufficient to serve as a rescue flotation in the event of emergency. In one embodiment, the floating assembly 100 includes an inflatable flotation device (not shown) coupled to the pump that may be inflated to serve as a raft for the diver and/or others.

In one embodiment an air intake tube 157 is coupled to the pump suction inlet. The air intake tube 157 may be removable to facilitate storage and may include sealing features when installed such as O-ring seals. The tube may be capable of functioning as a mount for standard diving flags, e.g., a flag indicating 'diver down'.

Ballast 153 may optionally be provided in some embodiments to lower the floating pump assembly 100 within the water, thereby lowering its center-of-gravity and the likelihood of capsizing. By appropriate selection of housing shape and weighting, a floating pump assembly 100 may be provided such that the only stable floating configuration is upright, and so that in the event of over-turning, the weighting and buoyancy characteristics cause the assembly to be self-righting, and thus assure that the air intake tube 157 remains above the water line 165, and in some embodiments generally perpendicular to it.

In one embodiment, a pump controller (e.g., controller 25 of FIG. 1, which may comprise part of a processor 24) may cause the pump to shut down temporarily upon detection of liquid entering the system For example, in one embodiment the floating pump assembly may be provided with a capsizing detector, e.g., an accelerometer, that detects when the pump is oriented such that the air intake tube 157 has (or has a high risk of having) taken in water. If so, the pump controller may automatically shut off the pump. The pump may optionally automatically restart the pump once the accelerometer signal indicates that the air intake tube 157 is oriented so as to preclude air intake or capsizing.

In one embodiment, a liquid sensor (not shown) may be provided in the air inlet 157 (or another appropriate location such as the pump inlet, the pump casing, or the pump outlet) to detect any water entering the air inlet 157, pump 128, or the tubing 30 (FIG. 1). If liquid is detected, in one embodiment the liquid sensor may provide a liquid detection signal to the pump controller, which may then take appropriate action. In one embodiment, the controller may signal or provide an alarm to the diver (or a person on the surface monitoring the system) by one or more of an electrical, mechanical, or optical element that liquid has entered the system The controller may notify the diver by an appropriate signal element (not shown) coupled to the breathable gas regulator (e.g., a light, a piezoelectric element, a mechanical element, or by interruptions in the gas supplied to the diver), and may notify a person on the surface by a similar signal element (e.g., a water intake alarm) coupled to the pump 128 or floating pump assembly 100.

In still another embodiment, the controller may cause the pump 128 to enter a water removal mode when water is detected. This may involve, e.g., opening a vent valve (not shown) in the floating pump assembly 100 or tubing 30, and closing an interrupt valve (not shown) downstream of the vent valve in the tubing 30 to prevent water delivery to the diver. The pump 128 may then be operated until the detected liquid can be cleared from the system, thereby avoiding pumping the liquid to the diver and risking the diver inhaling it. In an alternative embodiment, the pump may again use the vent valve and interrupt valve, but may reverse the direction of operation of the pump to clear the liquid back through the air inlet 157. In still another embodiment, the controller may simply shut off the pump 128 when water is detected in the air path. Finally, the pump may simply continue to operate if water enters the system, and the diver may manually clear through the regulator assembly any water entering the air inlet 157.

In some embodiments, all interior parts of the pump 128 are made of corrosion-proof materials. Suitable materials may include stainless steels, titanium, nickel, or other alloys resistant to rust and/or salt water corrosion, as well as numerous polymers and composites. Materials capable of withstanding many millions of cycles and years of operation may also be selected. As with SCUBA or SSA systems, the diver may manually clear water from the regulator by forcing the pump to continue operating until all of the water has cleared the system and air flow has returned. Such a course of action will only be possible, however, if the entry of water is only temporary. In one embodiment, if the air inlet is capsized for an extended period, the system may suspend pumping if the water has not been cleared within a predetermined time period, e.g., 5-10 seconds.

In one embodiment, an air tube 130 coupling the pump outlet to a regulator assembly (e.g., regulator assembly 42 in FIGS. 4 and 5) is provided. The air tube may be removable to facilitate tube cleaning, storage, inspection, or replacement. In one embodiment, a quick-disconnect fitting is provided to facilitate rapid attachment and removal of the tube 130 from the floating pump assembly 100 without the use of tools.

The location at which the air tube 130 is coupled to the pump assembly housing 150 is chosen such that no force reasonably likely to be experienced by the air tube would cause the pump assembly housing 150 to tip over and submerge the air intake tube 157. The location is further chosen to allow the entire floating pump assembly 100 to be pulled through the water and follow the diver's movement in response to tension on the air tube 130, as with pulling on the bow of a boat. In some embodiments, as seen in FIG. 6, the location of air tube 130 is under the water line 165 so that any heating due to gas compression at the pump is quickly dissipated via the tube's 130 contact with water.

In some embodiments, the pump assembly housing 150 includes a pump housing compartment 160 for the pump which during operation is intentionally flooded with water such as through openings 163 in the pump assembly housing, and as depicted here, with an un-sealed back of the housing's hull (FIG. 7, opening 164). Allowing the pump to be submerged within the pump housing compartment 160 of the pump assembly housing 150 substantially reduces or eliminates uncontrolled and/or transient buoyancy caused by unused air spaces inside the housing, which may shift the center of gravity of the floating pump assembly 100 and destabilize its self-righting ability. Unused air spaces in the housing may also create buoyancy space that would need to be counteracted by additional ballast 153, making the entire system heavier. Additionally, a submerged pump design for the pump assembly housing 150 advantageously provides superior cooling of the motor's components, such as power amplifiers and magnetic coils 162, compared to non-submerged systems. The pump assembly housing 150 may also include drain holes or apertures (e.g., 164 and 163) to allow for the flooded internal area to naturally and quickly drain when the system is removed from the water.

In some embodiments, the pump 128 includes electromotive mechanical elements and pumping elements, and situates the elements or components of the pump that produce heat under load on the outside of the pump housing to facilitate cooling by the water in the pump housing compartment 160. These include electromagnetic coils 162 and power amplifiers (not shown) where necessary. Although the electromagnetic coils 162 are outside the pump and exposed to water, they are separated by the motor housing such that the moving parts inside the pump housing are not exposed to water. The electromagnetic coils 162 may in some embodiments be coated with a sealing medium such as a polymer coating, yet because of the water-cooled design, still provide for heat removal superior to air-cooled motor coils. Efficiency is improved as electrical resistance is reduced by keeping the coils cool.

Pump sensory elements are placed such that the system will not overheat in the event a user runs the pump without being submerged. The pump sensory elements may include temperature sensors located near the hottest components, or water presence/absence sensors (not shown).

In some embodiments, pump 128 is constructed so as to be unaffected by, and capable of continuing to run, even in the event of water intake into the pump inlet. To this end, in some embodiments the mechanical elements of the pump 128 are chosen so as to not require lubrication. This may include utilizing roller or ball bearings composed of plastic or other non-corroding materials. In some embodiments, diaphragm-type pump designs, which do not create high skin friction such as piston-type pumps within cylinders are used. In some embodiments, pump geometries capable of providing adequate breathing air volume without fast motor speeds are used. Slow motor speeds reduce wear per unit time of use, and prevent heat build-up in the moving components. In still other embodiments, over-sized one-way valve(s) may be used to allow for rapid clearing of ingested water. In some embodiments, sequencing control of the pump electromagnet is provided by contact-less sensors (such as a Hall effect sensor) instead of brushed motors whose components would be harmed by water.

In some embodiments, motor sequencing control of the pump electromagnetics is based on the position of the pumping elements (i.e., the pistons, diaphragms, etc.). As previously noted, in some embodiments permanent magnets that are fully encapsulated in polymer or other corrosion inhibitor are used to prevent deterioration in the event of moisture exposure, and ports leading to pump exits may be situated low within the pump assembly housing to promote expulsion of ingested water. Ingested water may be ultimately purged through the port 46 (FIG. 5), again at a gravitationally low location in the system Referring again to FIGS. 6-8, the pump 128 is also, in some embodiments, constructed so as to facilitate rapid cleaning after use. In particular, the pump is designed to be capable of continuing to run in the event of ingestion of sanitizing solution into the pump inlet, and with components that are unaffected by cleaning agents (e.g., soap, bleach, peroxide, etc.). Sanitizing the entire system may then be accomplished without disassembly by immersing the air intake tube 157 of the pump 28 into sanitizing solution and briefly running the pump. After a brief liquid-based cleaning period, the sanitizing solution may easily be purged by removing the air intake tube 157 and running the pump in air. In some embodiments, the entire system is designed to allow disassembly and reassembly without tools, or with minimal tools.

In some embodiments, key components may be made of transparent polymers to allow for inspection of the breathing air system to rapidly identify any corrosion, dirt, microbial/infective matter, or wear. In some embodiments, components may be provided that are coated or impregnated with anti-microbial properties to minimize the risk of infection or adverse health effects to the diver.

In some embodiments, the pump assembly uses multiple pumping elements (e.g., two or more cylinders, diaphragms, or other pumping elements). The multiple cylinders may be run out of sequence so as to minimize pressure fluctuation (i.e., pressure waves) in the breathing tube that would be uncomfortable or cause anxiety for the diver. By providing an appropriate number of cylinders whose maximum compression cycles are time-staggered, a smooth and consistent air supply to the diver can be provided. In addition, multi-cylinder designs allow for slower operating speeds and thereby reduced heat development and wear.

As a further means to reduce pressure waves in the air supply tubing, in some embodiments the system incorporates chambers where air can expand in order to further minimize pressure waves in the breathing tube. The system may incorporate accumulator chamber mechanisms such as a flexible reservoir or bladder that can deflect under varying pressures to further minimize pressure waves in the breathing tube. In some embodiments, a chamber may be provided at the pump outlet in a space within the pump assembly housing 150, while in other embodiments a chamber may be provided at an intermediate position in the tubing 30. A tubing chamber and swivel fittings may also be used to minimize kinking or knotting within the tubing. Other anti-kinking features may also be provided, e.g., corrugations or other surface features.

As shown in FIGS. 6-8, pump assembly housing 150 may incorporate a handle 167 to facilitate one-handed carrying of the system by a diver or other user. The handle may be situated such that the largest system dimension hangs downward so that the handle hangs comfortably and naturally close to a person's side without requiring tiring and injury-prone effort to hold it away from the body while walking. The handle 167 may be foldable for stowage, or may be utilized as a switch or lock in operating the system such as to command power-on or off, or to latch or unlatch a door or opening in the housing 150 for repairs or maintenance.

The system also includes a power source such as a battery 126, which is situated to facilitate rapid, easy access for charging or replacement. In a preferred embodiment, the system includes a water-proof battery housing within or coupled to the pump assembly housing 150, with water-proof electrical contacts or a standard waterproof plug assembly. In an alternative embodiment (not shown), the battery 126 may be housed in an openable battery housing compartment that may be closed (e.g., with latches) to provide a waterproof seal, which may permit use of a non-water-proof battery with non-water-proof contacts inside the compartment.

The battery 126 and other electrical components, including magnet coils 162, are preferably situated so as to not be in fluid communication with breathing air. This prevents the diver from breathing contaminates in the event of an electrical failure of these components, and ensure that the breathable air path to the diver remains as clean as possible.

In some embodiments, the system may include water filters and/or drying elements upstream or downstream of the pump to remove liquid and/or reduce the humidity of the air supplied to the diver. In one embodiment, shown in FIGS. 6 and 7, an air filter 169 is provided at the pump outlet near the connection with the tubing. By providing a filter 169 housed within the pump assembly housing 150, the filter may be conveniently changed while performing routine maintenance on the system In another embodiment (not shown), a filter is provided at a location proximal to the regulator to prevent any contaminates in the pump outlet or tubing from reaching the diver. This may be a commercially available respirator filter such as a class P90 or P100 filter.

Figure 9:
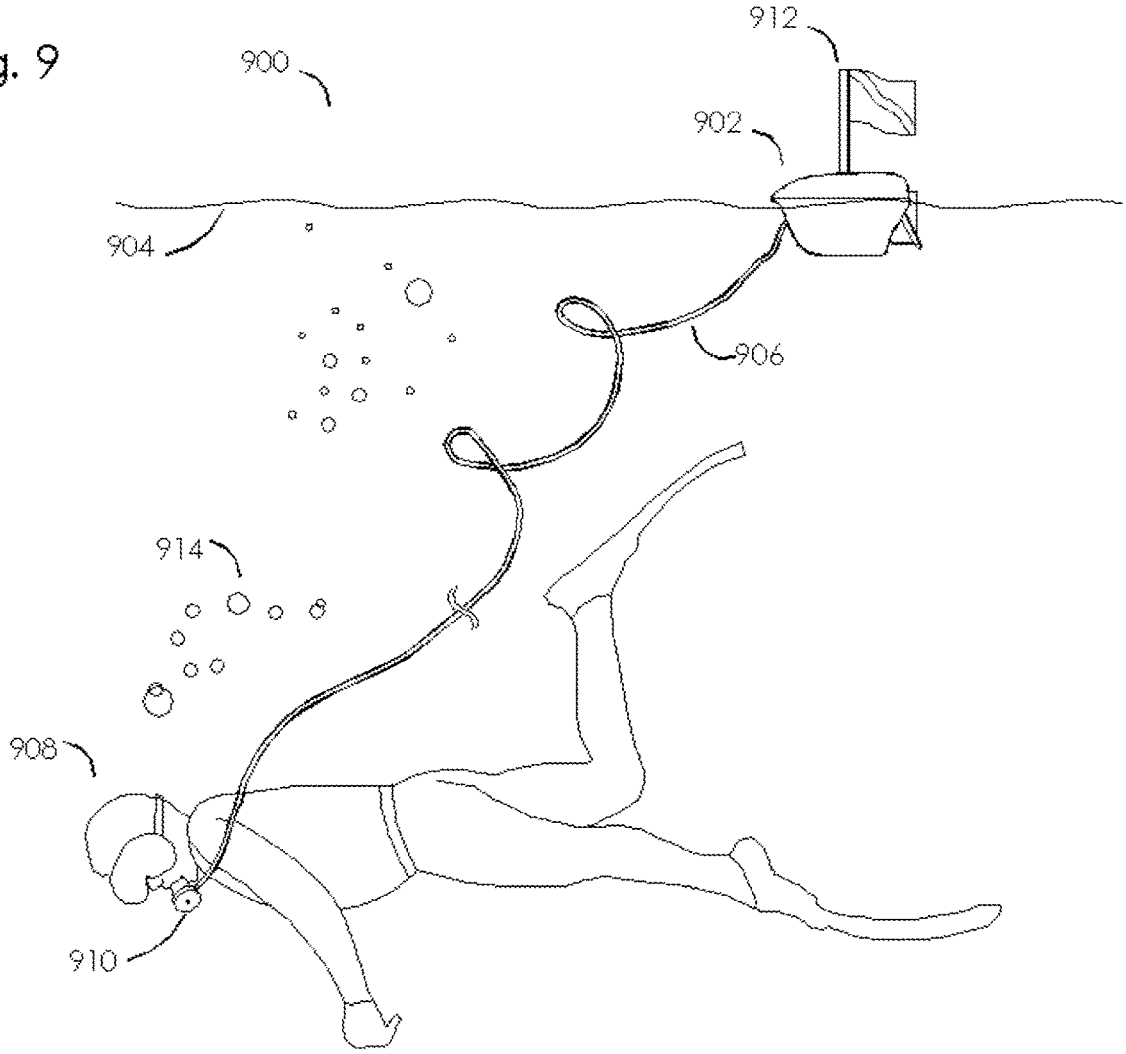
FIG. 9. is an embodiment of an integrated system including the user in an exemplary environment.

FIG. 9 depicts an embodiment of an integrated system according to the present disclosure including a diver in an exemplary environment 900. The diver 908 is depicted beneath the water line 904. In one embodiment, a floating pump assembly 902 collects air from above the water line such as through an air intake tube 912, and pumps the air into a tube 906 to be delivered to a regulator assembly 910 that includes a mouthpiece, allowing the diver to use a standard SCUBA mask that encompasses the diver's eyes and nose. In another embodiment, the regulator assembly 910 may engage the diver's nose for delivering breathing air, or a structure that encompasses both the nose and mouth. Exhaled air may be exhausted directly into the aquatic environment 914 or channeled via a return line (not shown).

Embodiments of the present invention provide underwater breathing systems requiring less energy than previous systems. Advantages of systems according to the present disclosure include, without limitation, lower component costs, lower weight, smaller size, simpler manufacturing (e.g., polymers instead of metals used in high pressure applications) and longer usable diving duration for any given energy supply. Many present systems on the market are so large, heavy, and/or bulky that transport is unwieldy (for example, two automobile batteries are used in many systems, and the flotation bladder is the size of an automobile tire) and the effort required for the diver to drag the floating unit while diving is substantial, which risks damaging the air tubing and/or tubing/housing connection, in addition to diver fatigue. Embodiments of the present invention can be accomplished in sizes and weights smaller than existing systems, yet still deliver over an hour of breathable air delivery from an on-board energy source (battery). Embodiments of the invention achieve lower energy use in part by utilizing significantly lower operating pressures than existing systems.

Lower system pressures facilitate improved safety, less heat buildup at the compressor, less component wear, and less starting load. By utilizing an on-demand, low-pressure pump that senses the diver's air needs and only operates in response to such need, systems of the present invention provide a significantly improved diving experience, reduced system bulk, and improved energy efficiency. By running the pump only when the user requests or needs breathing air, systems of the present invention not only provides a much more natural diving experience, but achieves significantly improved energy efficiency (at least 2× and usually 10×). Because the pump may be off approximately half (or more) of the time the diver is submerged, systems of the present invention provide the diver with at least double (and usually 4×) the total breathing time for a given energy source versus continuously running free-flowing systems, without the constant distraction and visual disturbances that plague such systems. One present commercial system, described in U.S. Pat. No. 5,327,849A, allows for the motor to slow or turn off during periods of low demand, but this is performed in a high-pressure system that simply responds to rising system reservoir pressures in a high-pressure compressor in the same way as in-home shop air compressors, thus requiring far more energy input than the present invention due to the build-up of high pressures necessary for that implementation.

In one embodiment, the present invention comprises an apparatus to sense a user's respiratory inhalation and deliver only that amount of gas volume and pressure required at the user's location (i.e., diving depth) by means of controlling the actions of a rapidly-responding pump more or less instantaneously (e.g., within 500 milliseconds) with inhalation demand. In some embodiments, systems of the present invention may be networked together in a linked configuration, permitting a central monitoring station (CMS) to monitor the safety and/or gather dive data for multiple divers. Boat charters to particular dive sites usually include many divers. Systems of the present disclosure may allow divers who are not certified SCUBA divers to participate in shallow-water dives (e.g., less than 40 feet (12 m), preferably less than 30 feet (9 m)) from a charter vessel, and the divers may be monitored from the boat from a CMS on the vessel. This may be accomplished by providing a wireless communication link electronically coupling each diver to the boat-based CMS.

Figure 10:
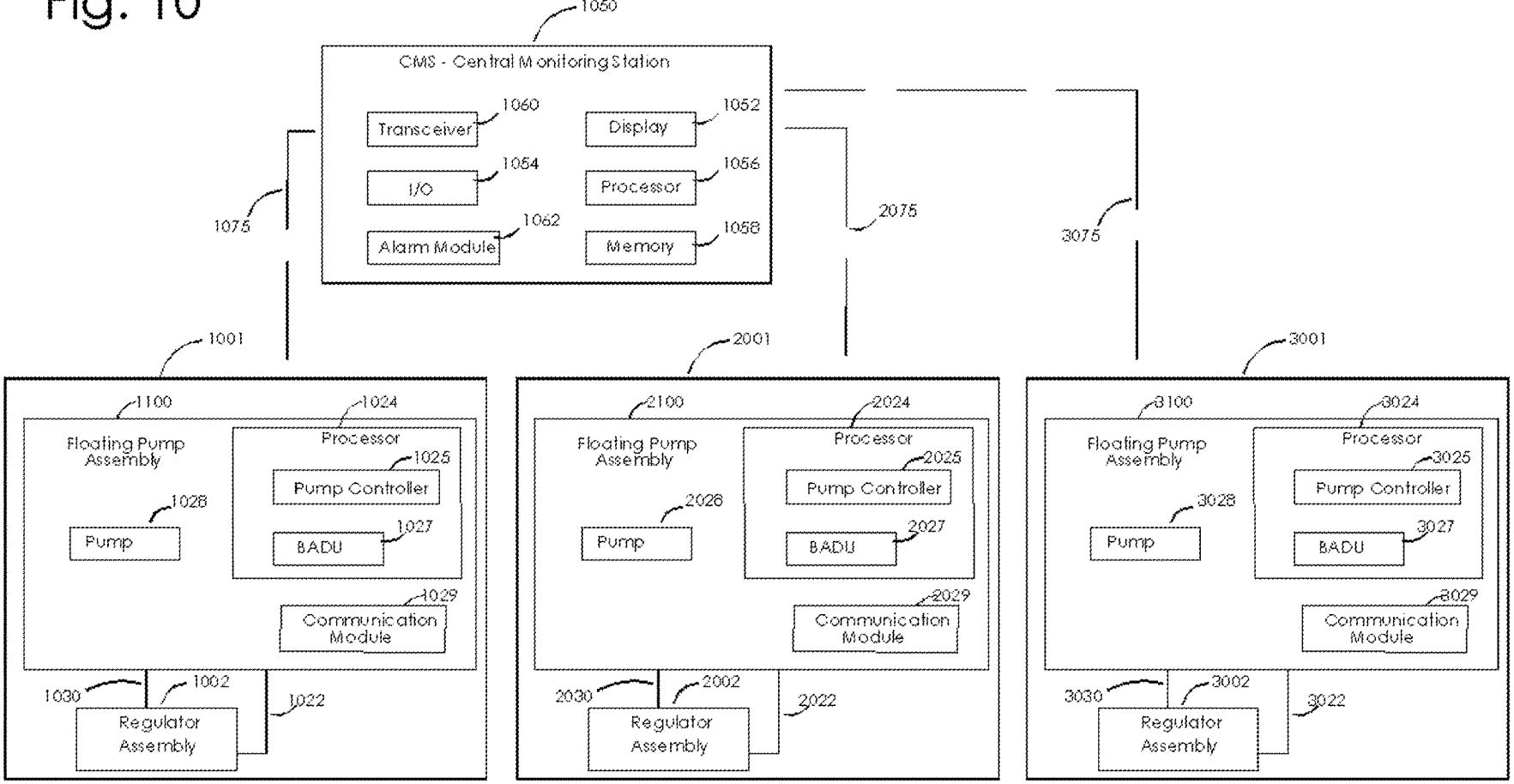
FIG. 10. is a system element diagram of a related grouping of systems operating in co-located environment.

FIG. 10 illustrates one embodiment of a networked system with a central monitoring station (CMS) capable of monitoring on-demand air supply systems for each of multiple divers. A CMS 1050 includes a transceiver 1060 for communicating with on-demand systems 1001, 2001, 3001, etc. for each of multiple divers. Although the networked system of FIG. 10 illustrates on-demand systems for three divers, it will be appreciated that there is no limitation on the number of divers that may be monitored by the CMS 1050. To simplify the discussion, the CMS 1050 will be described in connection with only a single on-demand system for one diver. However, it should be understood that similar details for on-demand systems for other divers (e.g., 2001, 3001, etc.) are also within the scope of the present system.

In one embodiment, the on-demand system 1001 for supplying air to a diver has a dedicated pump 1028 and associated electronics (e.g., processor 1024, BADU 1027, and/or pump controller 1025) wirelessly coupled to the CMS 1050 via a communications module 1029. The communications module 1029 may be included within or as part of processor 1024, or in combination with BADU 1027 or pump controller 1025. In still other alternative embodiments, the communications module 1029 is not part of the respective floating pump assembly 1100. Regardless of how the communication module 1029 is implemented electronically, the communication module for each system (e.g., 1001, 2001, 3001) is capable of transmitting data to the CMS 1050 for display, analysis, and/or recording by the CMS. In some embodiments, the CMS 1050 may also transmit data to the communication module 1029, e.g., to provide data and/or commands to the processor 1024, BADU 1027, or pump controller 1025. The CMS 1050 may include a processor 1056 that includes software and/or firmware to perform analysis of the data received from the diver's communications module 1029. A display 1052 may be provided to display data received from the communications module 1029 of the diver's system 1001 or data generated by the processor 1056 of the CMS 1050. An input/output (I/O) device 1054 such as a standard keyboard may be provided to allow the operator of the CMS 1050 to take appropriate actions. Additional standard computing hardware and/or software, such as a memory 1058, may also be included.

As previously noted, in some embodiments, the processor 1024 of the diver's system 1001 may take responsive actions such as 1) logging and/or displaying data regarding unsafe conditions, 2) providing one or more alarms to the diver and/or a monitor, and 3) implementing corrective action(s). In some embodiments of the system of FIG. 10, all or portions of these responsive actions may be performed by the CMS 1050 (e.g., using processor 1056). In one embodiment, the communication module 1029 may transmit data relating to the diver's system 1001 to the CMS 1050 either continuously or at various time intervals (e.g., every 1, 5, 10, or 30 seconds). The data transmitted by the communication module 1029 may also include data generated by the processor 1024 about the course of the diver's dive, including without limitation the diver's depth over time, location relative to the vessel, breathing status, battery status, etc.

The data transmitted by the communication module 1029 may also include data about the diver (e.g., name, age, weight, medical conditions, etc.), although in some embodiments diver data (e.g., diver medical data) may be maintained solely in the CMS 1050 to ensure better security to comply with HIPAA and/or other health information privacy standards. Regardless of where the information is maintained, the CMS 1050 may use the data relating to the diver to implement diver-specific responsive actions. For example, users with risk factors such as anxiousness or inexperience may be monitored more closely or alarm and/or dive limits may be set more stringently. The communication module 1029 may transmit numerous alarms or warnings to the CMS 1050 for display or other mode of presentation to appropriate personnel, including but not limited to warnings when each diver has exceeded a predetermined depth (which may be individually programmed for each diver), whether a diver has ceased breathing (i.e., inhaling and/or exhaling) for longer than a threshold time period, the remaining estimated dive time available for each diver given the battery supply for that diver, etc. The CMS 1050 may be used by the dive master on the vessel to ensure the safety of each diver, and may provide a record for legal or other purposes for safety verification and/or records to comply with government or industry monitoring standards, or as part of the diver's individual diving log.

The foregoing information (whether determined by processor 1024 or by processor 1056 of CMS 1050) may be presented to a CMS operator in various ways, e.g., visually or auditorily; as graphs vs. time or as instantaneous status signals; as instantaneous values that change colors or blink when an alarm limit is reached. For example, the CMS 1050 may display diver depth vs. time on an X-Y axis, or may display instantaneous depth numerically in black at shallow depths but change to a blinking red number when a maximum depth is reached. Similarly, an instantaneous breathing rate may be provided based on a moving average (e.g., based on time or timestamps derived from inhalation or exhalation signals). In another example, an alarm may sound and a visual warning may be provided on the display 1052 if the diver ceases breathing for more than a predetermined time limit.

In alternative embodiments (not shown) involving a CMS 1050, the diver may have a dedicated pump 1028 and associated electronics located on the vessel rather than on a floating pump assembly 1100. In still other embodiments, each diver may be connected to a common air supply (not shown), which provides air to multiple divers through a single or multiple pumps located on the vessel. Although the embodiment of FIG. 10 involving central monitoring systems 1050 has been discussed in connection with a boat or other aquatic vessel, in some embodiments, the CMS may be positioned on a dock or fixed platform in proximity to the body of water for diving, rather than on a vessel. In still other embodiments, the CMS may be portable and worn by a dive master or other group member who is themselves participating in the dive.

In some embodiments, systems of the present invention may be rented to divers on a temporary basis. For operators of such rental systems, additional embodiments to facilitate theft prevention, safety, system health and maintenance tracking, and monitoring of rental divers may also be provided. In addition to the foregoing features, numerous security features may be provided to enable a rental operator of a CMS 1050 to track the systems (1001, 2001, 3001, etc.) used by one or more rental divers. In some embodiments, for example, a processor 1024 on the rental system 1001 may automatically determine numerous status parameters and transmit them to a CMS 1050 including, without limitation: the total diving time of the rental diver (which the CMS 1050 may use to determine rental fees); a diagnostic log for each rental system 1001, 2001, etc. to notify the CMS when any mechanical or electrical malfunction occurs; a safe status indicator to verify that the system is functioning correctly when issued to and/or retrieved from the rental diver.

Additional features on the rental diving system 1001 and/or the CMS 1050 may include, without limitation, a physical lock on the battery compartment of the system, which may be keyed (physically or electrically) to require entry of an access code to enable the diver to operate the system; an anti-theft electrical interlock to enable the rental diving system 1001 to operate only if the rental diving system receives a signal from the CMS 1050, which can only occur if the system is within a predetermined distance (e.g., wireless range) of the CMS; GPS-based anti-theft features to disable the system if it is removed more than a predetermined distance from the set range; programmable usage time which allows the system to operate for only a specific time (i.e., hours, days, etc.) after the system is issued to the rental diver. For such systems, additional safety features may be provided to prevent shut-down of the pump if the user is submerged when the time period ends.

Emergency features may also be provided in some instances. For example, a visual distress signal such as a flag may be deployed on the floating pump assembly 1100 if the diver ceases breathing for a predetermined time period. In more extreme cases, the communication module 1029 may automatically call an emergency responder (e.g., 911 services, or a lifeguard for rental systems located on known nearby areas), or may trigger the floating pump assembly to deploy an emergency flare to signal rescuers of the diver's position. The processor 24 may include one or more of dedicated hardware, software and/or firmware processing to enable the above-noted features. By providing data such as the foregoing to a rental operator, the CMS 1050 may be used by the rental operator to ensure diver safety, for security of the diving systems 1001, 2001, 3001, etc., and to create records for legal or other purposes, e.g., for safety verification and/or records, to comply with government or industry monitoring standards, or as part of the diver's individual diving log.

In another aspect, the present disclosure provides methods for providing breathable gases (e.g., air) to a submerged diver using systems such as those previously described. The systems generally include a pump, a breathable air regulator having a pressure sensor for sensing pressure within the regulator, and a tube coupling the pump to the regulator. In some embodiments, the methods are suitable for delivering air to a submerged diver at shallow depths (e.g., 35 feet (10.7 m) or less).

Figure 11:
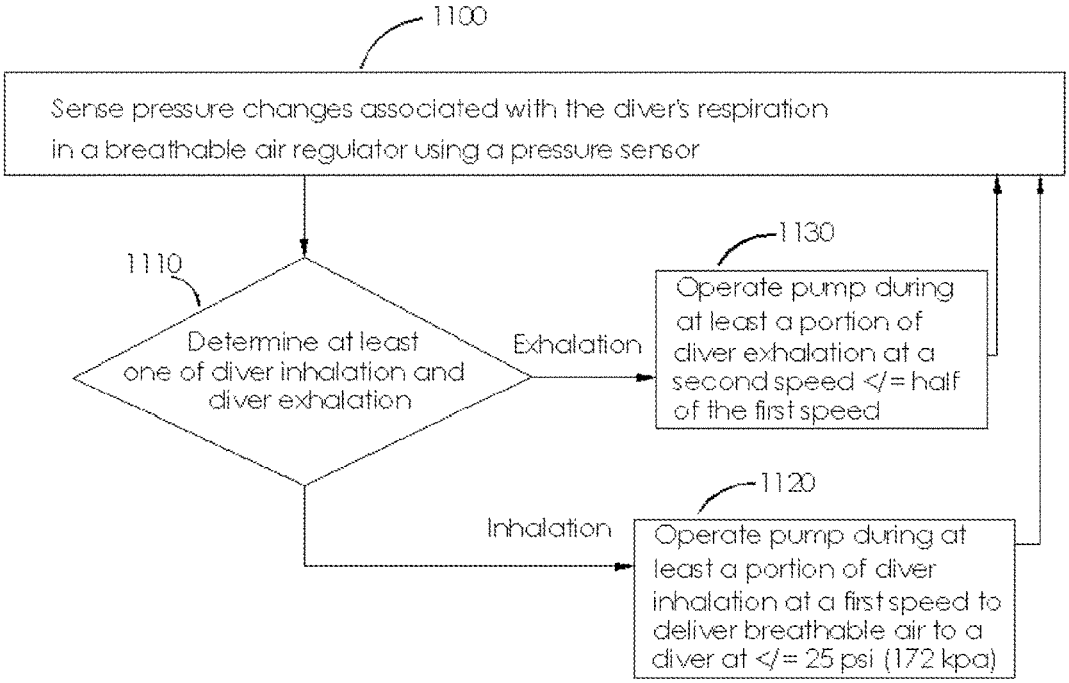
FIG. 11. is a flow diagram showing a method of providing breathable air to a submerged diver in a system having a pump, a breathable air regulator, and a tube coupling the pump and regulator.

FIG. 11 illustrates one embodiment of a method of providing breathable gases such as air to a submerged diver in a system having a pump, a breathable air regulator having a pressure sensor to measure pressure in the regulator, and a tube coupling the pump to the regulator to deliver breathable gases from the pump to the regulator. In some embodiments, the regulator may comprise a regulator as illustrated in FIGS. 1-5 and as previously described. In some embodiments, the pump may be part of a floating pump assembly as described in FIGS. 6-8, including a buoyant element. In alternative embodiments, different pumps may be used.

Referring again to FIG. 11, the method includes sensing pressure changes associated with diver respiration in a breathable air regulator using a pressure sensor (1100). As noted, the regulator includes a pressure sensor coupled to the regulator for sensing pressure changes during diver inhalation and diver exhalation. As previously noted in connection with FIGS. 1-5, as the diver inhales, air withdrawn from the regulator chamber causes the pressure to drop, while breathing gases exhaled into the regulator causes the pressure in the regulator to rise. The method further comprises determining at least one of diver inhalation and diver exhalation (1110). A determination of at least one of inhalation and exhalation may be determined, e.g., by a Breathable Air Determination Unit 27 (FIGS. 1-3), based on the regulator pressure changes sensed by the pressure sensor. In one embodiment, step of determining at least one of inhalation and exhalation (1110) may occur repeatedly at a high speed (e.g., multiple times per second such as 2, 5, 10, 20, 50, 100 or even more times per second).

The method also includes actions taken in response to the determination of at least one of inhalation and exhalation, respectively. The method includes operating the pump during at least a portion of diver inhalation at a first pump speed to deliver breathable air to the submerged diver at a pressure of no more than 25 psi (172 kpa) above atmospheric pressure (1120). In one embodiment, step 1120 may include operating the pump during the entirety of diver inhalation to deliver low pressure breathable air at 25 psi (172 kpa) or less. In some embodiments, step 1120 may include starting the pump slightly before or after the start of diver inhalation. This may include, in one embodiment, causing the pump to begin operating at the first pump speed at a time point within a range of 0.5 seconds before to 0.5 seconds after a start of diver inhalation.

The method also includes operating the pump during at least a portion of diver exhalation at a second speed that is no greater than half the first speed (1130). In one embodiment, the second speed may be zero. In one embodiment, step 1130 may include causing the pump to begin operating at a second speed of zero slightly before or after a determination of diver inhalation is made. This may include, in one embodiment, causing the pump to begin operating at the second pump speed of zero at a time point within a range of 0.5 seconds before to 0.5 seconds after a start of diver inhalation. In a particular embodiment, this may include operating the pump at a pump speed of zero from the start of exhalation to the end of exhalation. As noted, the step 1110 of determining at least one of inhalation and exhalation may occur repeatedly at a high speed. When this is done repeatedly during diver exhalation, in some embodiments, the step 1130 of operating the pump during at least a portion of diver exhalation may comprise continuing to operate the pump at a second speed of zero until a time point within a range of 0.5 seconds before to 0.5 seconds after a start of diver inhalation.

In one embodiment, when a determination (step 1110) of exhalation is made immediately after diver exhalation begins, the pump may still be operating at the first speed, and the step (1130) of operating the pump during at least a portion of exhalation may comprise slowing the pump from the first speed to the second speed beginning at a time point within a range of 0.5 seconds before to 0.5 seconds after the start of diver exhalation. In another embodiment, the slowing may begin at a time point within a range of 0.25 seconds before to 0.25 seconds after a determination of diver exhalation is made in step 1110.

In some embodiments, the method may also include a step (not shown) of causing the pump to pump breathable air to the diver in response to a manual input from the diver. This manual option provides an increased level of safety and reassurance to the diver, who may manually initiate operation of the pump, e.g., by pressing a button to cause air flow to clear the regulator of water.

Figure 12:
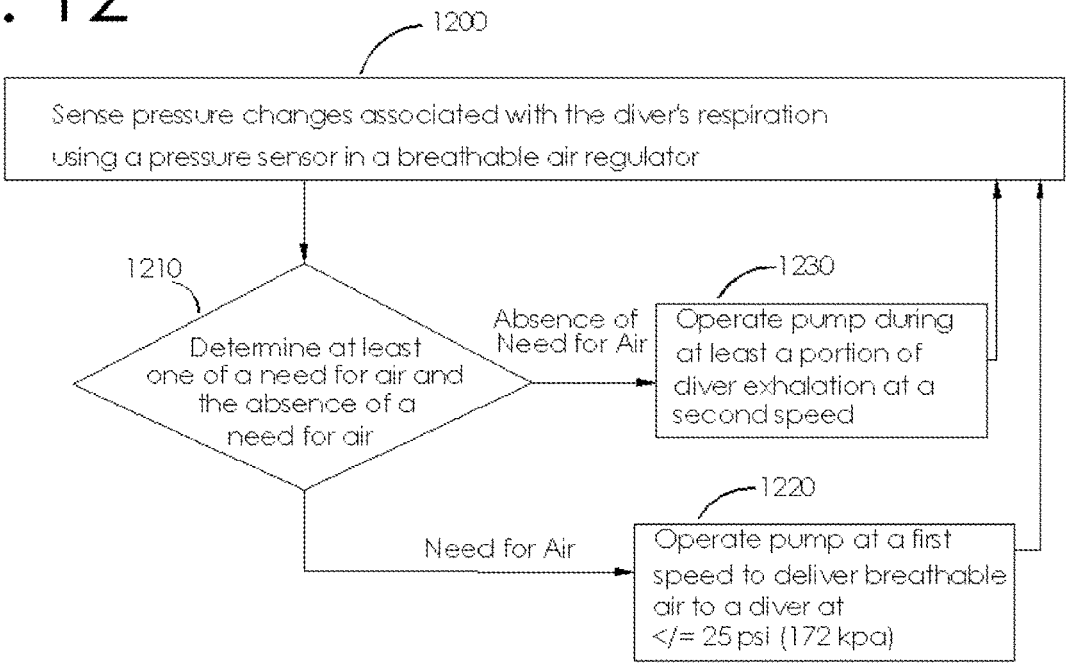
FIG. 12. is a flow diagram showing another method of providing breathable air to a submerged diver in a system having a pump, a breathable air regulator, and a tube coupling the pump and regulator.

FIG. 12 illustrates another embodiment of a method of providing breathable gases such as air to a submerged diver in a system having a pump, a breathable air regulator having a pressure sensor coupled to the regulator to measure pressure in the regulator chamber, and a tube coupling the pump to the regulator to deliver breathable gases from the pump to the regulator. In some embodiments, the regulator may comprise a regulator as illustrated in FIGS. 1-5 and as previously described. In some embodiments, the pump may be part of a floating pump assembly as described in FIGS. 6-8, including a buoyant element. In alternative embodiments, the pump may not be part of a floating pump assembly.

Referring again to FIG. 12, the method includes sensing pressure changes in the regulator associated with diver respiration using a pressure sensor (1200). As noted, pressure sensor coupled to the regulator senses pressure changes during diver inhalation and diver exhalation. As previously noted in connection with FIGS. 1-5, as the diver inhales, air withdrawn from the regulator chamber causes the pressure to drop, while breathing gases exhaled into the regulator causes the pressure in the regulator to rise. The method further comprises determining, based on the step of sensing (1200), one of a need for air by the diver and the absence of a need for air by the diver (1210). In one embodiment, the need for air may be determined by detecting an indication of inspiration, or by detecting the absence of expiration. In one embodiment, the absence of a need for air may be determined by detecting an indication of expiration, or by detecting the absence of inspiration. A determination of the need for air or the absence of a need for air may be determined, e.g., by a Breathable Air Determination Unit 27 (FIGS. 1-3), based on the regulator pressure changes sensed by the pressure sensor. In one embodiment, the step of determining one of a need for air and the absence of a need for air (1210) may occur repeatedly at a high speed (e.g., multiple times per second such as 2, 5, 10, 20, 50, 100 or even more times per second). This may involve making a plurality of determinations at a selected frequency (e.g., 2, 5, 10, etc. times per second), of one of a need for air and the absence of a need for air.

The method of FIG. 12 also includes operating the pump, in response to determining a need for air by the diver, at a first pump speed to deliver breathable air to the submerged diver at a pressure of no more than 25 psi (172 kpa) above atmospheric pressure (1220). In one embodiment, the determining step (1210) comprises making a plurality of determinations at a frequency of at least two times per second, and the step of operating the pump to deliver breathable air to the diver (1220) comprises causing the pump to deliver breathable air to the diver prior to the next of the plurality of determinations. In one embodiment, the determining step (1210) comprises making a series of determinations, at a frequency of at least two times per second, of one of a need for air by the diver and the absence of a need for air by the diver, and the step of operating the pump to deliver breathable air to the diver (1220) comprises operating the pump, within no more than 0.5 seconds after each determination of a need for air by the diver within the series of determinations, at the first speed to deliver breathable air to the diver at a pressure of no more than 25 psi (172 kpa) above atmospheric pressure. In one embodiment, operating the pump at the first speed comprises delivering breathable air to the diver at a pressure of no more than 15 psi (103 kpa) above atmospheric pressure. In one embodiment, operating the pump at the first speed comprises causing the pump to begin operating at the first speed within no more than 0.25 seconds after the determination of a need for air by the diver.

The method also includes operating the pump, in response to determining the absence of a need for air by the diver, at a second speed that is no greater than half the first speed (1230). In one embodiment, the second speed may be zero. In one embodiment, the determining step (1210) comprises making a plurality of determinations at a frequency of at least two times per second, and the step of operating the pump in response to determining the absence of a need for air by the diver (1230) comprises causing the pump to not pump air to the submerged diver until a determination of the plurality of determinations comprises determining a need for air by the diver. In one embodiment, step 1230 comprises causing the pump to begin operating at a second speed within no more than 0.5 seconds after determining the absence of a need for air by the diver. In one embodiment, the determining step (1210) comprises making a series of determinations, at a frequency of at least two times per second, of one of a need for air by the diver and the absence of a need for air by the diver, and the step of operating the pump in response to determining the absence of a need for air by the diver (1230) comprises operating the pump, within no more than 0.5 seconds after each determination of the absence of a need for air by the diver within the series of determinations, at a second speed that is no greater than half the first speed. In one embodiment, operating the pump at the second speed comprises causing the pump to begin operating at the second speed within no more than 0.25 seconds after the determination of the absence of a need for air by the diver.

In some embodiments, the method may also include a step (not shown) of causing the pump to pump breathable air to the diver in response to a manual input from the diver. This manual option provides an increased level of safety and reassurance to the diver, who may manually initiate operation of the pump, e.g., by pressing a button to cause air flow to clear the regulator of water.

The particular embodiments disclosed above are illustrative only, as the invention may be modified and practiced in different but equivalent manners apparent to those skilled in the art having the benefit of the teachings herein. Examples are all intended to be non-limiting. Furthermore, exemplary details of construction or design herein shown are not intended to limit or preclude other designs achieving the same function. It is therefore evident that the particular embodiments disclosed above may be altered or modified and all such variations are considered within the scope and spirit of the invention, which are limited only by the scope of the claims.

Embodiments of the present invention disclosed and claimed herein may be made and executed without undue experimentation with the benefit of the present disclosure. While the invention has been described in terms of particular embodiments, it will be apparent to those of skill in the art that variations may be applied to systems and apparatus described herein without departing from the concept, spirit and scope of the invention. It should be especially apparent that the principles of the invention may be applied with other modes of sensing including optical, capacitive, resistive, sonic, and the like, and that the users of remotely supplied breathing gases may be other than those performing underwater diving, such as rescue operations or toxic or potentially toxic gas environments, e.g. volcanoes or sulfurous vents, high dust environments, manufacturing environments involving nitrogen blanketing or purging of equipment, firefighting operations involving toxic gases, etc.

In various embodiments, the present invention relates to the subject matter of the following numbered paragraphs:

51. A system to provide breathable gases to a submerged diver, comprising:

a pump having a pump inlet fluidly coupled to a source of breathable gases at a first pressure and a pump outlet providing pressurized breathable gases to a submerged diver at a second pressure greater than the first pressure by no more than 50 psi;

a breathable gas regulator assembly including a regulator chamber having a regulator inlet, a regulator outlet, a mouthpiece fluidly coupled to the regulator chamber and having a breathing aperture, an articulating element, and a pressure sensor to provide a pressure signal indicative of whether breathable gases are needed by the diver based on movement of the articulating element;

tubing coupling the pump outlet to the regulator inlet; and a pump controller to control the operation of the pump based on the breathing gas signal.

52. The system of 51, wherein the second pressure is greater than the first pressure by no more than 25 psi.

53. The system of 52, wherein the second pressure is greater than the first pressure by no more than 15 psi.

54. The system of 51, wherein the pump provides pressurized breathable gases to a submerged diver at a second pressure that is not substantially greater than the pressure necessary to supply the needed gas volume at the pressure determined by the diver's water depth.

55. The system of 51, wherein the system does not include a pressure reduction valve to reduce the second pressure at the pump outlet.

56. The system of 51, wherein the system does not include a pressure reduction valve between the pump outlet and the mouthpiece.

57. The system of 51 further comprising a buoyant element, wherein said pump is coupled to said buoyant element.

58. The system of 51, wherein the pressure sensor is an electronic sensor, and wherein said pump controller is capable of causing the pump to begin pumping within 700 milliseconds or less of receiving a breathing gas signal indicating that breathable gases are needed by the diver.

59. The system of 51, wherein the pressure signal is indicative of at least one of inhalation and exhalation by the diver.

60. The system of 51, wherein the pressure sensor is an electronic sensor, and wherein the pump controller causes the pump to pump pressurized breathable gases to the diver when the pressure signal indicates that breathable gases are needed by the diver, and causes the pump to not pump breathable gases to the diver when the pressure signal does not indicate that breathable gases are needed by the diver.

61. The system of 51, wherein the pump controller turns the pump off when the pressure signal does not indicate that breathable gases are needed by the diver.

62. The system of 51, wherein said system comprises a single pump and a single tube, and provides breathing gas to a single diver.

101. A system to provide breathable air to a submerged diver, including:

a floating pump assembly comprising a buoyant element, a pump coupled to said buoyant element, said pump having a pump inlet fluidly coupled to the atmosphere, and a pump outlet, said pump operating to provide pressurized breathable air at the pump outlet at a pressure greater than atmospheric pressure by no more than 25 psi;

a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver inhalation and exhalation and to provide a regulator pressure signal indicative of the pressure changes;

tubing coupling the pump outlet to the regulator inlet;

a breathable air determination unit to determine when breathable air is needed by the diver based on the regulator pressure signal, and to provide a breathable air signal indicative of whether breathable air is needed by the diver; and a pump controller to control the operation of the pump in providing breathable air to the diver, based on the breathable air signal.

102. The system of 101 wherein said breathable air regulator assembly further comprises an articulating element, wherein said articulating element moves in response to pressure changes associated with diver inhalation and exhalation, and wherein said pressure sensor senses pressure changes within the regulator chamber based on movement of the articulating element.

103. The system of 101 wherein the breathable air determination unit determines diver inhalation based upon the regulator pressure signal, and wherein said breathable air signal comprises a first value when the diver is inhaling, and a second value when the diver is not inhaling.

104. The system of 101 wherein said regulator pressure signal and said breathable air signal are real-time signals.

105. The system of 104, wherein said pump controller is capable of causing the pump to begin pumping within 700 milliseconds or less of receiving the breathable air signal.

106. The system of 101 wherein the pump outlet provides pressurized breathable air to a submerged diver at a second pressure that is not substantially greater than the pressure necessary to supply the needed breathable air volume at the pressure determined by the diver's water depth.

107. The system of 101, wherein the system does not include a pressure reduction valve to reduce the second pressure at the pump outlet.

108. The system of 101, wherein the system does not include a pressure reduction valve between the pump outlet and the mouthpiece.

109. The system of 101, wherein the pump outlet pressure is greater than atmospheric pressure by no more than 15 psi.

110. The system of 101, wherein the pump outlet pressure is greater than atmospheric pressure by no more than 10 psi.

111. The system of 101, wherein the floating pump assembly comprises a single pump coupled to said buoyant element, and the system provides breathable air to a single diver.

112. The system of 101, wherein the floating pump assembly further comprises at least a second pump coupled to the buoyant element, and wherein said system further comprises a second breathable gas regulator and a second tubing coupled to said second pump, wherein said second pump, second breathable gas regulator and said second tubing provide breathable air to a second diver.

113. The system of 101 wherein the breathing gas determination unit and the pump controller comprise a single processor.

114. The system of 101 wherein the breathable air signal comprises one or more of an inhalation signal indicating that the diver is inhaling and needs air, and an exhalation signal indicating that the diver is exhaling and does not need air.

115. The system of 101, wherein the breathable air signal comprises a value within a range of values, and wherein said value is indicative of the magnitude of the said regulator pressure signal.

116. The system of 102, wherein the breathable air signal comprises value selected from a plurality of values, and wherein said value is in proportion to the magnitude of the movement of said articulating element.

201. A regulator assembly for a submerged diver, comprising: a regulator body comprising a breathing gas inlet (4) for receiving breathing gas;

a breathing gas outlet (6) for elimination of exhalation gases;

a mouthpiece (10) having a breathing aperture (8) through which the diver inhales and exhales;

a regulator chamber in fluid communication with the breathing gas inlet, the breathing gas outlet, and the breathing aperture;

a pressure sensor (20) to sense pressure changes within the regulator chamber associated with diver inhalation and exhalation and to provide a regulator pressure signal indicative of the pressure changes; and tubing (30) having a first end coupled to the breathing gas inlet (4) and a second end coupled to a breathing gas source at a pressure of 25 psi or less;

wherein said regulator assembly does not include a pressure drop valve to reduce the pressure of breathing gas received from the breathing gas source.

202. The regulator assembly of 201, further comprising an articulating element capable of moving in response to inhalation and exhalation of a diver, wherein said pressure sensor provides said regulator pressure signal based on movement of the articulating element.

203. The regulator assembly of 201, wherein said pressure sensor provides a regulator pressure signal having a value in proportion to the magnitude of the pressure in the regulator body.

204. The regulator assembly of 202, wherein the pressure sensor provides a regulator pressure signal having a value in proportion to the magnitude of the movement of the articulating element.

205. The regulator assembly of 201, further comprising a one-way check valve (31) coupled to said breathing gas inlet, wherein the one-way check valve is capable of closing in response to pressure created in the breathing gas chamber during exhalation by the diver to prevent the exhalation gases from traveling into said tubing toward said air source.

206. The regulator assembly of 201, wherein said tubing has a length of at least 5 feet.

301. A system to provide breathable air to a submerged diver, including:

a floating pump assembly comprising a buoyant element, a pump coupled to the buoyant element, the pump having a pump inlet fluidly coupled to the atmosphere, and a pump outlet providing pressurized breathable air at the outlet at an outlet pressure greater than atmospheric pressure by no more than 25 psi;

a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver inhalation and exhalation and to provide a regulator pressure signal indicative of said pressure changes;

tubing coupling the pump outlet to the regulator inlet;

a breathable air determination unit to determine inhalation by the diver based on said regulator pressure signal, the breathable air determination unit providing an inhalation signal when the diver is inhaling; and a pump controller to cause the pump to operate when the processor provides the inhalation signal, and to not operate when the processor does not provide the inhalation signal.

302. The system of 301, wherein the pump controller causes the pump to control the volume of breathing gases delivered to the diver based on the inhalation signal.

303. The system of 301, further comprising an articulating element, wherein the pressure sensor provides said regulator pressure signal based on movement of the articulating element.

304. The system of 301, wherein the breathable air determination unit and the pump controller comprise a single unit.

305. The system of 301, wherein the pressure sensor provides a regulator pressure signal having a value in proportion to the regulator chamber pressure, the breathable air determination unit provides an inhalation signal having a value in proportion to the regulator pressure signal value during inhalation, and the controller causes the pump to pump breathable air at a flow rate based on the inhalation signal value.

306. The system of 303, wherein the pressure sensor provides a regulator pressure signal having a value in proportion to the magnitude of the movement of the articulating element, the breathable air determination unit provides an inhalation signal having a value in proportion to the regulator pressure signal value, and the controller causes the pump to pump breathable air at a flow rate that is based on the inhalation signal value.

401. A system to provide breathable air to a submerged diver, comprising:

a pump having a pump inlet fluidly coupled to the atmosphere and a pump outlet, said pump operating to provide pressurized breathable air to a submerged diver at a second pressure greater than atmospheric pressure by no more than 25 psi;

a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes;

tubing coupling the pump outlet to the regulator inlet;

a breathable air determination unit to determine, based on the regulator pressure signal, at least one breathing state of the diver selected from inhalation, exhalation, and non-breathing, and to provide a breathing state signal indicative of the at least one breathing state; and a pump controller to cause the pump to operate to pump breathable air to the diver during a breathing state signal indicative of either 1) inhalation or 2) neither exhalation nor non-breathing, and not operate during a breathing state signal indicative of either 1) non-inhalation and 2) either exhalation or non-breathing.

402. The system of 401 further comprising an articulating element, wherein said pressure sensor senses pressure changes within the regulator based on movement of the articulating element.

403. The system of 401 wherein said breathable air determination unit determines diver inhalation based upon the regulator pressure signal, and wherein said pump controller causes the pump to operate to pump breathable air to the diver during a breathing state signal indicative of inhalation.

404. The system of 402 wherein said breathable air determination unit determines diver exhalation based upon the regulator pressure signal, and wherein said pump controller causes the pump to operate to pump breathable air to the diver during a breathing state signal indicative of non-exhalation.

405. The system of 401 wherein said regulator pressure signal is a real-time signal and said breathing state signal is a real-time signal.

406. The system of 401, wherein said pump controller is capable of causing the pump to begin pumping within 700 milliseconds or less of receiving said breathing state signal.

407. The system of 401, wherein the pump provides breathable air to a submerged diver at a second pressure that is not substantially greater than the pressure determined by the diver's water depth.

408. The system of 401, wherein the system does not include a pressure reduction valve between the pump outlet and the mouthpiece.

409. The system of 401, wherein the regulator pressure signal comprises a real-time signal having a value in proportion to the regulator chamber pressure, the breathing state signal comprises a real-time signal having a value in proportion to the regulator pressure signal, and wherein said pump controller causes the pump to pump breathable air at a flow rate that is based on at least one of the regulator pressure signal value and the breathing state signal value.

410. The system of 402, wherein the regulator pressure signal comprises a real-time signal having a value in proportion to the movement of the articulating element, and wherein said pump controller causes the pump to pump breathable air at a flow rate that is based on the regulator pressure signal value.

501. A system to provide on demand breathable air to a submerged diver, composing: a pump having a pump inlet fluidly coupled to the atmosphere and a pump outlet, the pump operating to provide pressurized breathable air to a submerged diver at a second pressure greater than atmospheric pressure by no more than 25 psi;

a breathable air regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes;

tubing coupling the pump outlet to the regulator inlet;

a breathable air determination unit to determine when breathable air is needed by the diver based on the regulator pressure signal, and to provide a breathable air signal indicating whether breathable air is needed by the diver; and a pump controller to cause the pump to operate to pump breathable air to the diver when the breathable air signal indicates that breathable air is needed by the diver, and to not provide breathable air to the diver when the breathable air signal does not indicate that breathable air is needed by the diver.

502. The system of 501 wherein the breathable gas regulator further composes an articulating element, wherein the pressure sensor provides the regulator pressure signal based on movement of the articulating element.

The system of 501 wherein the breathable air determination unit and pump controller comprise a single processor.

504. The system of 501 wherein said regulator pressure signal and said breathable air signal are real-time signals.

505. The system of 504, wherein said pump controller receives said breathable air signal from the breathable air determination unit, and is capable of causing the pump to begin operating within 700 milliseconds or less of receiving the breathable air signal.

506. The system of 501 wherein said breathable air determination unit determines at least one breathing state of the diver selected from inhalation, exhalation, and non-breathing, and wherein the pump controller causes the pump to pump breathable air to the diver only during either 1) inhalation or 2) neither exhalation nor non-breathing, and not operate during either 1) non-inhalation or 2) either exhalation or non-breathing.

507. The system of 501 wherein said breathable air determination unit determines at least one breathing state of the diver selected from inhalation, exhalation, and non-breathing, and wherein the pump controller causes the pump to pump breathable air to the diver only during either inhalation or non-breathing, and causes the pump to not operate during either 1) non-inhalation or 2) exhalation.

508. The system of 501, wherein the system does not include a pressure reduction valve between the pump outlet and the mouthpiece.

509. The system of 501, wherein the pump outlet pressure is greater than atmospheric pressure by no more than 15 psi.

510. The system of 501, wherein the pump outlet pressure is greater than atmospheric pressure by no more than 10 psi.

511. The system of 501, further comprising a buoyant element that floats on the surface of the diving medium, wherein the pump is coupled said buoyant element.

512. The system of 511, wherein a single pump is coupled to said buoyant element, and the system provides breathing gas to a single diver.

513. The system of 511, further comprising at least a second pump coupled to the buoyant element, and wherein said system further comprises a second breathable gas regulator and a second tubing coupled to said second pump, wherein said second pump, second breathable gas regulator and said second tubing provide breathable air to a second diver.

601. A system to provide on demand breathable air to a submerged diver, comprising:

a pump having a pump inlet fluidly coupled to the atmosphere and a pump outlet, the pump operating to provide pressurized breathable air to a submerged diver at a second pressure greater than atmospheric pressure;

a breathable gas regulator assembly including a regulator chamber having a regulator inlet and a regulator outlet, a mouthpiece fluidly coupled to the regulator chamber and having a breathing aperture, and a pressure sensor to sense pressure changes within the regulator chamber associated with diver breathing and to provide a regulator pressure signal indicative of the pressure changes;

tubing coupling the pump outlet to the regulator inlet;

a breathable air determination unit to determine when the diver is exhaling based on the regulator pressure signal, and to provide a breathable air signal indicating whether or not the diver is exhaling; and a pump controller to cause the pump to operate to pump breathable air to the diver when the breathable air signal indicates that the diver is not exhaling, and to not provide breathable air to the diver when the breathable air signal indicates that the diver is exhaling.

602. The system of 601 wherein the pump operates to provide pressurized breathable air to a submerged diver at a second pressure greater than atmospheric pressure by no more than 25 psi.

What is claimed is:

1. A system to provide breathable air to a submerged diver comprising:

a) a floating pump assembly comprising:

1) a buoyant element; and 2) a pump coupled to the buoyant element, the pump having a pump inlet fluidly coupled to the atmosphere and a pump outlet, and being adapted to provide breathable air at the pump outlet at first volumetric flow rate and a first pressure greater than atmospheric pressure by no more than 25 psi;

b) a breathable air regulator assembly comprising:
1) a regulator chamber having a regulator inlet and a regulator outlet;
2) a mouthpiece fluidly coupled to the regulator chamber and having a breathing aperture adapted for use by the submerged diver for inhalation and exhalation; and
3) a pressure sensor to sense pressure changes within the regulator chamber associated with inhalation and exhalation by the submerged diver, and adapted to provide a real-time regulator pressure signal indicative of the pressure changes in the regulator chamber;

c) tubing having a proximal end coupled to the pump outlet and a distal end coupled to the regulator inlet, and adapted to transmit breathable air from the pump to the regulator chamber for breathing by the submerged diver; and d) a breathable air determination unit to determine when breathable air is needed by the submerged diver based on the real-time regulator pressure signal; and e) a pump controller to control the operation of the pump in providing breathable air to the submerged diver when breathable air is needed by the submerged diver.

2. The system of claim 1 wherein said breathable air regulator assembly further comprises:
4) an articulating element adapted to move in response to pressure changes associated with diver inhalation and exhalation, and wherein said pressure sensor senses pressure changes within the regulator chamber based on movement of the articulating element.

3. The system of claim 1 wherein the breathable air determination unit determines one or more of diver inhalation and diver exhalation based upon the regulator pressure signal, and wherein the pump controller controls the operation of the pump based on the determination of one or more of inhalation and exhalation.

4. The system of claim 1 wherein the breathable air determination unit is further adapted to provide a real-time breathable air signal indicative of a need for air by the submerged diver, and the pump controller is adapted to receive the real-time breathable air signal and to cause the pump to begin pumping within 500 milliseconds or less of receiving the real-time breathable air signal.

5. The system of claim 1 wherein the pump controller is adapted to cause the pump to provide pressurized breathable air at a first volumetric flow rate of at least 62.5 liters/minute and a first pressure greater than atmospheric pressure by no more than 15 psi.

6. The system of claim 1, wherein the system does not include a pressure reduction valve between the pump outlet and the mouthpiece.

7. The system of claim 1, wherein the floating pump assembly comprises a shape adapted to be self-righting and capsize-resistant.

8. The system of claim 1, wherein the system comprises:
a first pump adapted to provide breathable air to a first submerged diver;
a second pump adapted to provide breathable air to a second submerged diver;
a first breathable air regulator assembly comprising a first regulator chamber, a first mouthpiece, and a first pressure sensor adapted to provide a first real-time regulator pressure signal indicative of the pressure changes in the first regulator chamber associated with inhalation and exhalation of the first submerged diver;
a second breathable air regulator assembly comprising a second regulator chamber, a second mouthpiece, and a second pressure sensor adapted to provide a second real-time regulator pressure signal indicative of the pressure changes in the second regulator chamber associated with inhalation and exhalation of the second submerged diver;
a first tubing having a first proximal end coupled to a first pump outlet and a first distal end coupled to a first regulator inlet; and
a second tubing having a second proximal end coupled to a second pump outlet and a second distal end coupled to a second regulator inlet;
wherein the breathable air determination unit comprises one or more breathable air determination units and is adapted to determine:
when breathable air is needed by the first submerged diver based on the first real-time regulator pressure signal; and
when breathable air is needed by the second submerged diver based on the second real-time regulator pressure signal; and
wherein the pump controller is adapted control:
the operation of the first pump to provide breathable air to the first submerged diver when breathable air is needed by the first submerged diver; and
the operation of the second pump to provide breathable air to the second submerged diver based on when breathable air is needed by the second submerged diver.

9. The system of claim 1 wherein the breathing air determination unit and the pump controller comprise one of a single processor or a plurality of processors.

10. The system of claim 1, wherein the pump controller is adapted to:
1) during inhalation by the submerged diver, operate the pump to provide pressurized breathable air at a first volumetric flow rate of at least 62.5 liters/minute during inhalation; and
2) during exhalation by the submerged diver, perform an operation selected from:
A) operating the pump to provide pressurized breathable air at a second volumetric flow rate less than the first volumetric flow rate; and
B) turning the pump off.

11. The system of claim 1, further comprising:
f) a processor adapted to determine the diver's depth based at least in part on the regulator pressure signal.

12. The system of claim 11, wherein the pump controller is further adapted to operate the pump in at least one of a first mode and a second mode based on the depth of the diver.

13. The system of claim 11, wherein the pump controller and the processor comprise a single unit.

14. The system of claim 12, wherein the pump controller is adapted to operate the pump to provide the first volumetric flow rate during inhalation in the first mode, and provide a second volumetric flow rate different from the first volumetric flow rate during inhalation in the second mode.

15. The system of claim 1, wherein the pump controller is further adapted to perform at least one action selected from:
determine a breathing rate based on the real-time regulator pressure signal, and control a pumping rate of the pump based at least in part on the determined breathing rate;
determine information relating to the operating status of the system;
detecting a fault condition;

logging information relating to at least one of the operating status of the system and a detected fault condition;

causing the system to enter a fail-safe operating mode;

taking an emergency action selected from activating an alarm and signaling for help;

logging one or more of the breathing and depth of the submerged diver for a particular dive;

providing feedback to the submerged diver;

controlling a light; and providing a signal to the submerged diver that a depth limit has been reached or exceeded.

16. A system to provide breathable air to a submerged diver, comprising:

a) a pump having a pump inlet fluidly coupled to the atmosphere and a pump outlet, wherein the pump is adapted to provide pressurized breathable air at the pump outlet at a first volumetric flow rate and a first pressure greater than atmospheric pressure by no more than 25 psi;

b) a breathable air regulator assembly comprising:

1) a regulator chamber having a regulator inlet and a regulator outlet;

2) a mouthpiece fluidly coupled to the regulator chamber and having a breathing aperture adapted engage a mouth of the submerged diver for inhalation and exhalation;

3) a pressure sensor to sense pressure changes within the regulator chamber associated with breathing by the submerged diver, and adapted to provide a regulator pressure signal indicative of the pressure changes;

c) tubing having a proximal end coupled to the pump outlet and a distal end coupled to the regulator inlet, and adapted to transmit breathable air from the pump to the regulator chamber for breathing by the submerged diver;

d) non-transitory, computer-readable medium having instructions stored thereon that, when executed by a processor, cause the processor to:

1) determine when breathable air is needed by the submerged diver based on the regulator pressure signal; and 2) control the operation of the pump to provide breathable air to the submerged diver based on the regular pressure signal.

17. The system of claim 16 wherein the non-transitory, computer-readable medium comprises instructions stored thereon that, when executed by a processor, cause the processor to perform at least one action selected from:

determine a breathing rate based on the regulator pressure signal, and control a pumping rate of the pump based at least in part on the determined breathing rate;

determine information relating to the operating status of the system;

detecting a fault condition;

logging information relating to at least one of the operating status of the system and a detected fault condition;

causing the system to enter a fail-safe operating mode;

taking an emergency action selected from activating an alarm and signaling for help;

logging one or more of the breathing and depth of the submerged diver for a particular dive;

providing feedback to the submerged diver;

controlling a light; and providing a signal to the submerged diver that a depth limit has been reached or exceeded.

18. The system of claim 16 wherein the non-transitory, computer-readable medium comprises instructions stored thereon that, when executed by a processor, cause the processor to:

determine, based on the regulator pressure signal, at least one breathing state of the submerged diver selected from inhalation, exhalation, and non-breathing; and control the pump to:

provide breathable air to the submerged diver at a first volumetric flow rate when breathable air is needed by the submerged diver; and when breathable air is not needed by the diver, perform an operation selected from:

providing breathable air to the submerged diver at a second volumetric flow rate less than the first volumetric flow rate; and not operating the pump.

19. The system of claim 16, wherein the non-transitory, computer-readable medium comprises instructions stored thereon that, when executed by a processor, cause the processor to control the pump to:

provide breathable air to the submerged diver at a first volumetric flow rate in response to a breathing state signal indicative of either 1) inhalation or 2) neither exhalation nor non-breathing; and in response to breathing state signal indicative of either 1) non-inhalation or 2) either exhalation or non-breathing, perform an operation selected from:

providing breathable air to the submerged diver at a second volumetric flow rate less than the first volumetric flow rate; and not operating the pump.

20. The system of claim 16, further comprising:

e) a buoyant element, wherein the pump is coupled to the buoyant element to provide a floating pump assembly having a shape adapted to be self-righting and capsize-resistant.

* * * * *